US005260678A

United States Patent [19]

Van Wagener et al.

[11] Patent Number: 5,260,678

[45] Date of Patent: Nov. 9, 1993

[54] FLUORESCENT-LAMP LEADLESS BALLAST WITH IMPROVED CONNECTOR

[75] Inventors: Raymond H. Van Wagener, Darien, Conn.; Robert A. Kulka, Livingston; Richard Hoogmoed, Hawthorne, both of N.J.; Stuart E. Sanders, Brandon; Fred P. Bauer, Mendenhall, both of Miss.

[73] Assignee: Magnetek, Inc., Paramus, N.J.

[21] Appl. No.: 680,699

[22] Filed: Apr. 4, 1991

[51] Int. Cl.[5] ..... H01R 13/58

[52] U.S. Cl. ..... 336/96; 174/DIG. 2; 336/107; 439/460; 439/562

[58] Field of Search ..... 174/DIG. 2, 52.2; 361/377; 336/107, 96; 439/418, 425, 444, 449, 460, 562

[56] References Cited

U.S. PATENT DOCUMENTS

| | | | |
|---|---|---|---|
| 2,487,468 | 11/1949 | Naysmith | 362/221 |
| 2,489,245 | 11/1949 | Sola | 174/16.1 |
| 2,595,487 | 5/1952 | Runge et al. | 439/231 |
| 3,360,687 | 12/1967 | Riesland | 174/DIG. 2 |
| 3,514,590 | 5/1970 | Shaeffer | 439/78 |
| 3,569,694 | 3/1971 | Comer et al. | 439/679 |
| 3,655,906 | 4/1972 | Robb | 174/DIG. 2 |
| 4,054,350 | 10/1977 | Hardesty | 439/478 |
| 4,185,223 | 1/1980 | Riesland et al. | 315/245 |
| 4,185,321 | 1/1980 | Iwahashi et al. | 307/449 |
| 4,277,728 | 7/1981 | Stevens | 315/307 |
| 4,399,391 | 8/1983 | Hammer et al. | 315/239 |
| 4,410,230 | 10/1983 | San Miguel | 439/682 |
| 4,566,749 | 1/1986 | Johnston | 439/425 |
| 4,636,023 | 1/1987 | Olsson | 439/449 |
| 4,674,015 | 6/1987 | Smith | 174/DIG. 2 |
| 4,729,740 | 3/1988 | Crowe et al. | 439/438 |
| 4,916,363 | 4/1990 | Burton et al. | 174/DIG. 2 |
| 5,006,764 | 4/1991 | Swanson et al. | 439/76 |

FOREIGN PATENT DOCUMENTS 751052 1/1967 Canada .

OTHER PUBLICATIONS

Valmont Electric XL Series "Plug-In" Literature.

*Primary Examiner*—Gary F. Paumen

*Attorney, Agent, or Firm*—Seldon & Scillieri

[57] ABSTRACT

A half-connector body has lateral ears that fit in small notches in the ends of the side walls of a ballast can, preferably at the top. An end wall, if present, traps the ears longitudinally in the notches; resilience of that wall, and of its attachment to the can bottom, enhance tight longitudinal fit. The half connector (a receptacle) presses against, and partly protrudes through an orifice in, the end wall (if present). Outside the ballast, in a new fixture, a jack slides freely in the receptacle to make wiring-harness connections. The jack has a ratchet-like manually operable hook to secure the jack until manually released. Each contact or lead in either half connector is preferably provided with individual strain relief by permanent deformation (as for example using a die punch, without heating or plastic flow) of the connector wall inward, to displace material irreversibly around the wires. In either the jack or receptacle, cylindrical female contacts make smooth wiping contact with bared ends of standard fixture wires held in the opposite half connector, serving as pin contacts. If the female contacts are in the jack, a person may replace conventional ballasts with this new one, by cutting and baring the old harness wires and inserting them individually into the receptacle. Alternatively, for field retrofit a jack can be supplied, e.g. with poke-in wiring.

53 Claims, 21 Drawing Sheets

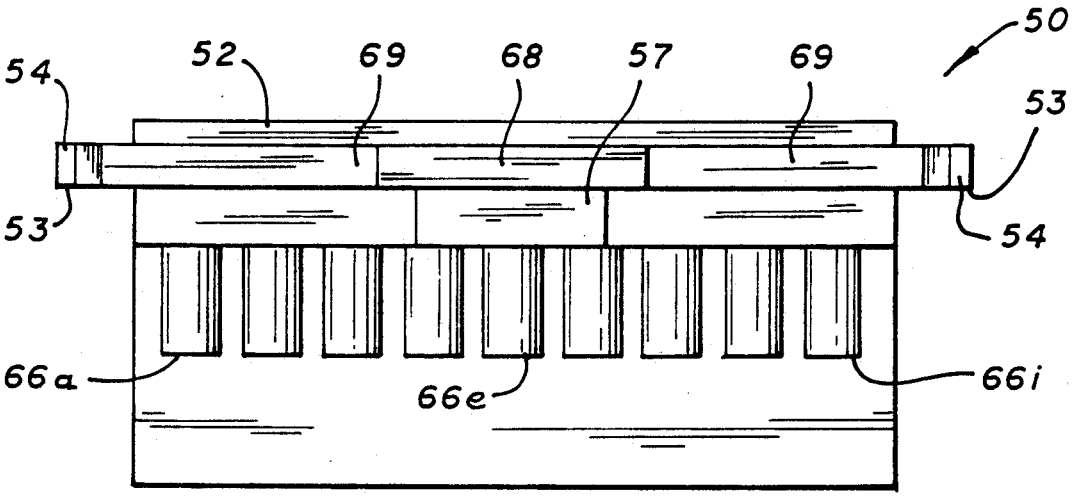
FIG. 16
FIG. 17
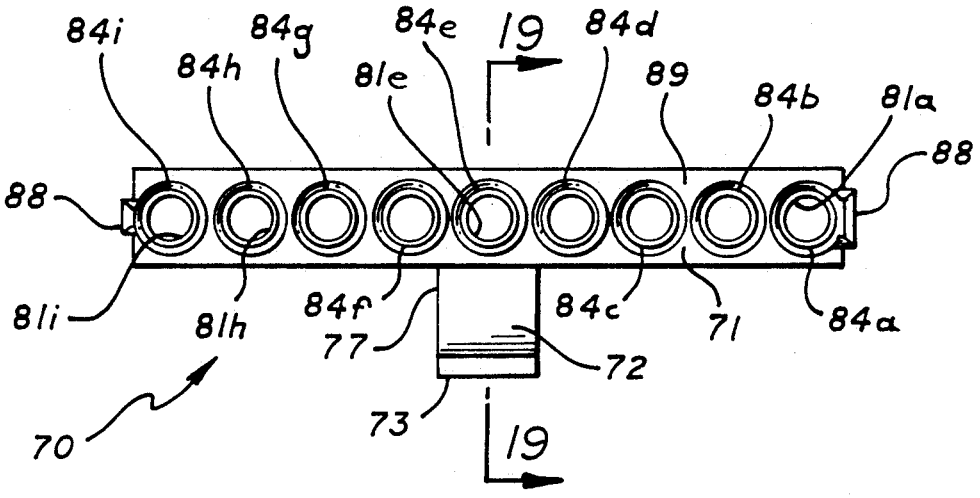
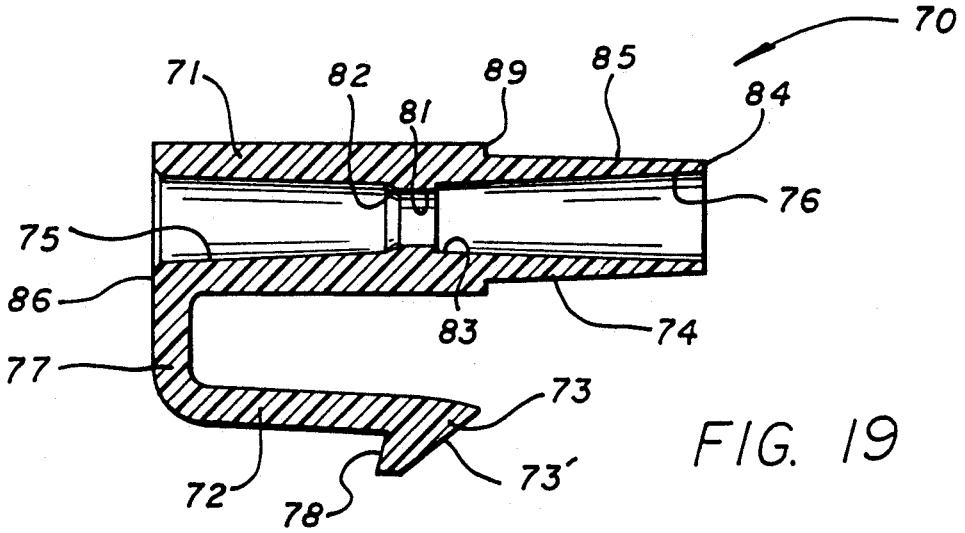
FIG. 19

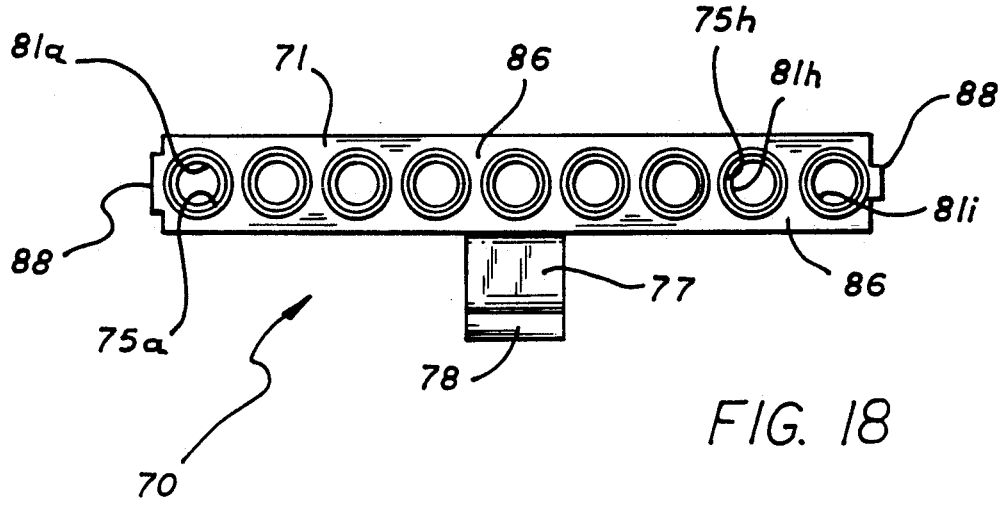
FIG. 18
FIG. 19A
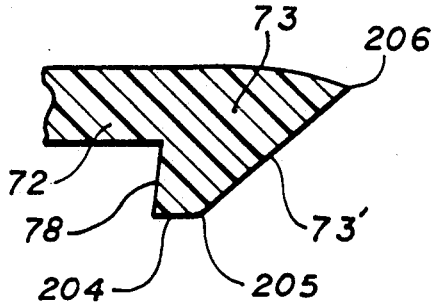
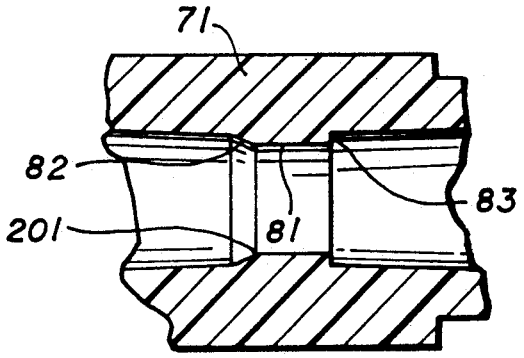
FIG. 19B
FIG. 20
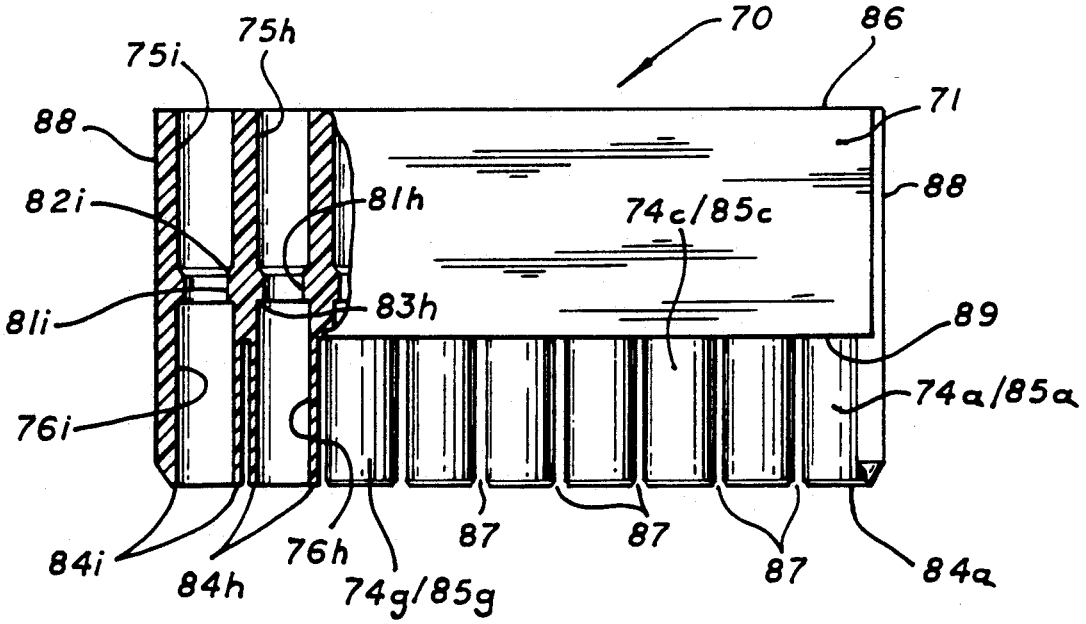

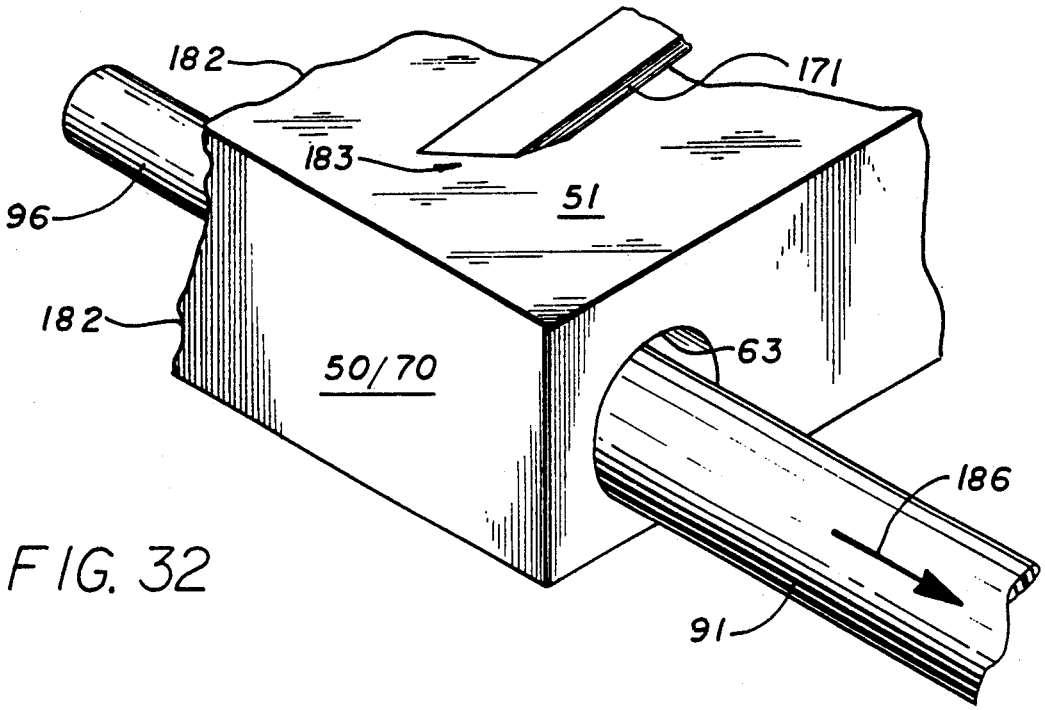
FIG. 32
FIG. 33
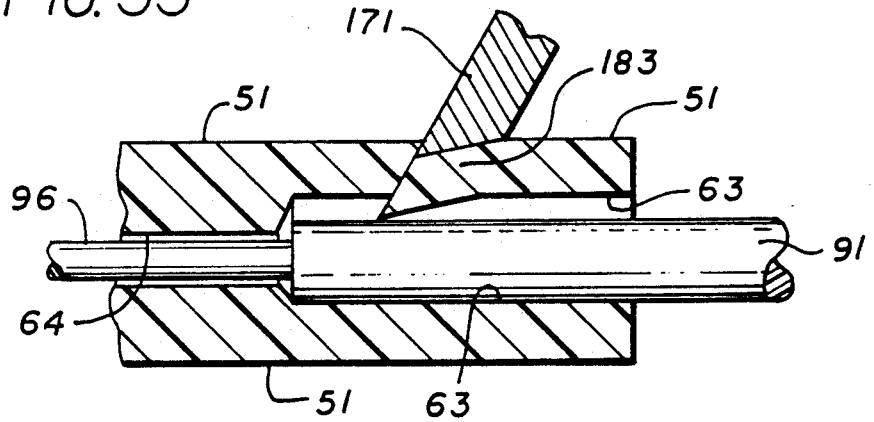
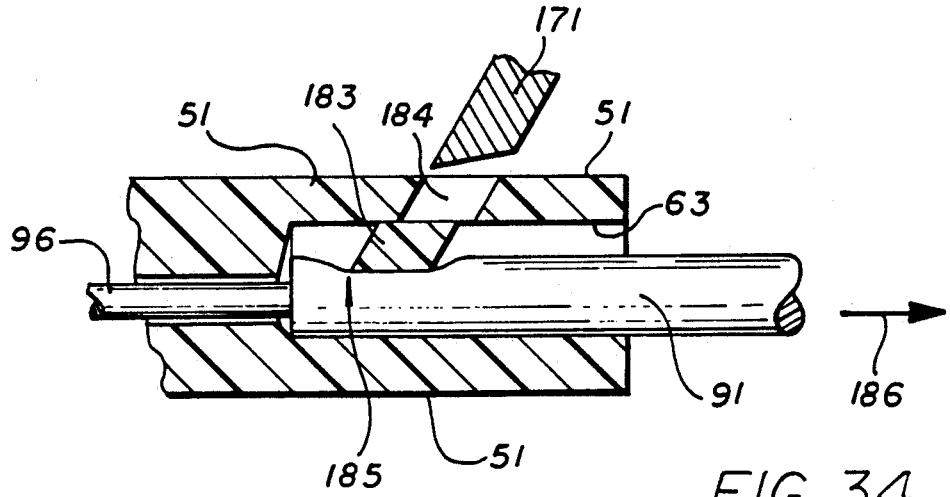
FIG. 34

FLUORESCENT-LAMP LEADLESS BALLAST WITH IMPROVED CONNECTOR

BACKGROUND

1. Field of the Invention

This invention relates generally to combined ballasts and wiring harnesses for fluorescent-lamp fixtures; and more particularly to so-called "leadless" ballasts that directly carry connectors for attachment to wiring in the fixtures.

2. Prior Art

Fluorescent lamps require relatively high starting voltages, and in many cases electrode heating. These are supplied by a combination of transformer coils, capacitors and thermal-overload circuit breakers, all usually potted together in a metallic enclosure familiarly known as a "ballast".

Some so-called "electronic ballasts" have much smaller, lighter coils and relatively much more extensive electronic circuitry. These units may be potted, or their components may be coated only lightly ("dipped") or not at all.

A typical indoor fluorescent-lamp fixture or luminaire is an elongated, narrow structure with an even narrower, shallow casing that extends the length of the fixture for mounting of fluorescent-lamp sockets and for housing of the ballast and the fixture wiring. As the ballast usually fits within (or sometimes upon) one of these narrow, shallow casings, the ballast too is usually made relatively long, narrow and shallow.

The ballast has its own enclosure, usually made of two sheet-metal pieces. One piece is die-cut and then bent to provide two generally vertical side walls, a generally horizontal floor, and conventionally a vertical wall at each end of the enclosure respectively. A second, flat piece (with mounting holes for attachment to the casing) forms a separate coverplate.

In this document we shall refer to the ballast by the nomenclature just established—in which the flat coverplate is considered to be the top of the ballast, and the horizontal panel that is made integrally with the side and end walls is considered to be the bottom. Ballasts are in that orientation when potting material is poured into the cans for potting the components, and usually or at least often are also mounted in that way. In any event we shall use this terminology for purposes of definiteness—although, for descriptive purposes, in many patents and other documents ballasts are shown inverted with respect to the convention just described; and ours too can be so oriented in use.

General practice in the fluorescent-lighting industry for more than a half century has been to provide wires that extend from within the ballast through a grommet or strain relief in each end wall, respectively. Some of these wires connect with a lamp socket mounted at each end of the lamp fixture, respectively; and others of the wires connect with the input power leads.

The ballast wires sometimes are made the correct length to just reach the sockets in some particular lamp model, and sometimes are made shorter, for attachment to other wires—often called the "wiring harness"—which then extend the remaining distance to the sockets. Representative patents exemplifying this standard configuration include U.S. Pat. Nos. 2,489,245 to Sola, 2,595,487 to Runge, 3,360,687 to Riesland, and 3,655,906 to Robb; as well as Canadian Patent 751,052 to Kukla.

Adherence to this basic form of ballast wiring has remained dominant in the industry despite issuance of many patents proposing seemingly reasonable variations. U.S. Pat. No. 2,487,468 issued in 1949 to Shirley R. Naysmith for one such variation—in which the wires from each end of the ballast terminate in respective half-connectors; these plug directly into mating half-connectors in lamp-socket assemblies, at the ends of the fixture respectively.

The Naysmith patent proposed that "all the wiring within the luminaire may be completed by merely plugging together the cable-carried receptacles to the fixed lamp holders." The inventor envisioned that fixture assembly would be thereby rendered so easy that "ballast units may be completed and pretested by the ballast manufacturer, the lamp holders by the lamp holder manufacturer, and shipped to the [installation] location in suitable lots without passing through the factory of the fixture manufacturer, thereby avoiding freight and handling, and the parts can be readily assembled on the job . . . " Naysmith's device is not a "leadless" ballast.

In U.S. Pat. No. 3,514,590, M. David Shaeffer proposed (1970) a leadless ballast, made to plug into a printed-circuit board that would—with a single backing plate—replace both the casing and the wiring of a fluorescent-lamp fixture. The lamp sockets as well as the plug-in ballast were to be supported at the underside of the printed-circuit board. Shaeffer's objective was that the entire fixture be amenable to assembly quickly and without the use of tools.

U.S. Pat. No. 3,569,694 of Oscar L. Comer posited in 1968 that a ballast-can coverplate be extended longitudinally beyond one end wall of the can, and that an array of laterally oriented connector pins be fitted to a vertical bracket on the baseplate extension. Short wires passed to these pins through the nearby end of the ballast can; and the pins in turn mated with a complementary array of laterally oriented female contacts mounted to the casing of the fixture. This unit thus might be called "almost leadless".

The plug-in concept was carried to its logical extreme in U.S. Pat. No. 4,674,015 of Daniel R. Smith, which in 1987 taught that the entire ballast should be plugged bodily sideways into a large receptacle in the casing. In Smith's leadless design, contact tabs on the interior wall of the receptacle engage mating contact tabs on the side wall of the ballast can.

U.S. Pat. No. 4,729,740 issued in 1988 to Crowe et al., showing a small printed-circuit board within the ballast can—and supporting all the other components in the can. In particular the internal circuit board supported at each end of the assembly a respective electrical connector for attachment of the several individual leads of a wiring harness leading to each half (i.e., each end) of the fixture respectively. Crowe's ballast too is thus a leadless configuration.

From Crowe's drawings it appears that his invention is intended primarily for use as one of the previously discussed "electronic ballast" types. His text, however, by its general language seems to suggest that the invention has broader application to more-conventional "magnetic" ballasts as well.

At each end of the assembly, Crowe's connector fits against the end wall of the can—except where the connector protrudes through a window cut in the end wall—and is longitudinally stabilized by grooves in the connector that receive the cut side edges of the window. We refer to this kind of mounting, in which the connector edges define a groove that makes a sliding engagement with the edges of a window in the end wall, as a "picture frame" mounting.

The firm with which we are associated, MagneTek Universal of Paterson, N.J., has introduced a leadless electronic ballast under the trademark "LUMINOPTICS" and covered by U.S. Pat. No. 4,277,728. It has a full-length circuit board generally analogous to Crowe's—but mounted to a flat plate that becomes the cover, rather than to the U-shaped body. It also has a second board that is much shorter and mounted vertically to the full-length board.

The LUMINOPTICS ballast is not potted, although some of the components are individually dipped. It has various modern features including a connection for computerized control, and a manual dimmer control.

A poke-in eight-contact wiring connector is provided at each end of the ballast, respectively. Each connector is mounted to a corresponding end of the full-length circuit board, accessible through a port in the associated end wall.

A groove defined in each of these connectors engages an inset flange formed at the bottom of the port, to stabilize the connector to the U-shaped body. A separate two-pin standard connector is installed in one end wall for power input.

Another leadless ballast design that uses an internal connector is disclosed by Burton et al. in U.S. Pat. No. 4,916,363 (1990), assigned to Valmont Industries, Inc. of Nebraska. Here the internal connector receives the wiring-harness wires either individually or in a connector-like carrier that organizes the wires into an array, but the internal connector is not mounted in the picture-frame style as in Crowe—and in fact is not in an end wall of the can at all.

Instead the internal connector is mounted in a transverse slot that extends all the way across the width of the bottom of the can, about a quarter or a third of the distance along the can from one end. At the side of the internal connector which faces toward that nearer end, the bottom of the can is formed in a shallow bevel that makes the connector face accessible for insertion of the wires.

The ballast can of Burton et al. is also formed with an inset longitudinal ledge (or, more strictly speaking, upside-down ledge) along each of its lower longitudinal corners. Each ledge is used for routing of wires from the connector in both longitudinal directions to the lamp sockets, and at each end is provided with "clamp portions"—apparently formed integrally with the ballast can—adapted to be bent over toward the inset ledge, to keep the wires on the ledge.

Because of the ledges along each lower corner, the cross-section of the can has a step at each corner. On one side of the transverse slot, the connector surfaces abut or fit against inside surfaces of the can all the way down both sides and across the bottom, including the corner steps. Therefore the connector too is notched or stepped at its lower corners.

At the other side of the transverse slot in the can, a flat surface of the connector abuts the cut-off edge of the slot. As will be seen, these several surfaces abutments at three different orientations pose at least a challenge to attainment of effective seals during potting.

Another modern development in leadless ballasts line of ballasts available from the Valmont Electric Company (a subsidiary of Valmont Industries) under the commercial designation "XL Series". Product labels for that line of ballasts identify U.S. Pat. Nos. 4,185,233, 4,185,321, and 4,399,391. An XL ballast has a single half-connector mounted in one end wall of the ballast can, and formed as a receptacle.

That wall-mounted receptacle receives another half-connector, configured as a jack, which terminates the wiring harness. The receptacle fits within, and protrudes slightly through, a window cut in the end wall of the can; while a flange around the receptacle is provided to press against the inner surface of the end wall, all around the window.

In the Valmont XL Series ballasts the receptacle carries a row of male contact pins, which are the tips of rectangular-cross-section metal strips leading from an intermediate terminal block. The terminal block is positioned about an inch inside the can, and is apparently held generally suspended (before potting) in that region by electrical leads soldered to contacts on the electrical components.

In the XL Series configuration, during potting, two small ratchet-style locking tabs—one at each end of the half connector, respectively—hold the receptacle flange against the inside of the wall. These tapered snap tabs, based on our own testing of such fasteners, give a better seal than the picture-frame retainers discussed earlier—but here too, at a production-engineering stage prove overly sensitive to the possibility of tolerances adding up adversely.

Since the contacts in the receptacle are male, the jack of course carries female contacts; within the jack the female contacts are permanently secured to the ends of the wires in the harness. These wires leave the jack body through a surface that faces the end wall of the can, so that at least those wires which lead to lamp sockets at the same end of the fixture as the jack are bent in a tight "U" shape.

Of the several variants discussed above, only the last three seem to have become commercially important. The concept of a leadless ballast does seem to be gaining some ground in the fluorescent-lighting industry. In fact a significant effort has been mounted by Valmont Industries to declare such ballasts—and, more particularly, the connector and pin configurations of the XL Series—and industry standard.

Perhaps the fluorescent-lighting industry could benefit from ballast standardization, but there is no standard yet. We believe that all of the above-discussed variations, including the two Valmont configurations, have important limitations which should be addressed and resolved before settling upon any of them, or even any combination of their features.

A few of the known features discussed above—especially the circuit-board mounting used in Crowe and the LUMINOPTICS ballast—appear adequate for some electronic ballasts, which are lighter and produce less vibration. As will be seen, however, such mounting is problematic for other electronic ballasts that do have relatively heavy radio-frequency-interference and power-factor filters, and also for the more-familiar magnetic ballasts, which still constitute by far the greatest fraction of ballast sales.

All or most of the remaining limitations seem to flow from inadequate recognition of several major characteristics of the overall process of ballast and fixture manufacturing, distribution, use and replacement. For specific reference we shall state these characteristics in the form of eight numbered "ground rules" for ballast design:

(1) The fluorescent-lighting industry is price competitive to an extreme. Profit margins in ballasts are correspondingly small, and production volumes are very high—so that manufacturing-cost advantages of only a fraction of a penny per ballast are likely to be significant.

(2) A major factor in ballast manufacturing cost is labor, particularly hand labor. Seconds lost in fussing with assembly or with touchy alignments and the like prior to potting, or later in wiping spilled or leaked potting potting material from the outside of each ballast, translate into major cost components.

(3) Material costs of course are also important, and militate strongly against use of additional intermediate components to perform limited functions. For example, the relatively expensive floating intermediate terminal block in the XL Series ballasts apparently is used primarily to obtain effective strain relief of the electrical leads inside the ballast can.

(4) Another cost-related consideration is that a ballast connector should be as compatible as practical with already-existing ballast-design and ballast-manufacturing techniques. Some changes in assembly-line equipment and layout or sequence can be very expensive, and as amortized—even over many hundreds of thousands of ballasts—can thereby add significantly to unit cost.

(5) Commendable wishes for industry standardization are not the same thing as actual achieved standardization. Any ballast configuration that is offered as a standard must offer users, distributors, fixture manufactures and ballast manufactures alike some reasonable means of coping with a protracted period of time during which standardization among manufactures is incomplete. In addition, regardless of leadless-ballast standardization, it seems unlikely that the industry will achieve complete standardization of fixture lengths, or accordingly of wiring-harness lengths.

(6) Any proposed standard ballast must also accommodate effectively an even more protracted replacement or retrofit period. During such a period the new-style ballasts must be used to replace millions of used ballasts of many different configurations—but primarily the long-time standard ones shown in, for example, the Sola, Runge, Riesland, Robb and Kukla patents mentioned earlier. Therefore a ballast connector should accommodate replacement or retrofit of earlier conventional ballasts that have protruding leads.

(7) Fluorescent-lamp fixtures intrinsically are roughly handled, knockabout items that must be designed to intrinsically withstand careless handling, and some degree of improper installation. Consumers do not treat fixtures or ballasts as if they were, for example, laboratory instruments or personal computers; therefore it is a mistake for designers to so treat them.

(8) Magnetic (and some electronic) ballasts themselves contain heavy components that can generate significant internal forces due to mechanical shock and vibration in shipping and handling. Once in operation they also generate heat and develop forcible vibrations, which often increase with use. Successful ballast designs therefore must avoid not only use of fragile elements, but also elements that when heated or vibrated can damage other nearby standard components (such as wiring).

Based upon these ground rules 1 through 8, we shall now comment upon the several ballast variants discussed above. We wish to make clear that all of these devices may serve (or may have served) reasonably well for their intended purposes; the comments that follow will simply show that there remains some opportunity for improvement.

The Naysmith design violates ground rules 1, 3, 5 and 6, as it requires a ballast with preattached cables, at least long enough to reach the lamp sockets, and it provides every new ballast with two relatively expensive half-connectors and cables. At the outset, Naysmith's proposed system would thus be prohibitively expensive, in modern terms.

Moreover, the connectors and cables of an older Naysmith ballast being replaced are discarded with the old unit, even though the old connectors and cables usually are in perfectly good condition. Worse yet, to use the ballast with an older standard fixture, the expensive connectors and cables must be cut off and discarded at the outset.

Even for use with various models of a single manufacturer the design is undesirable. The manufacturer must assemble, and then the distributor must stock, ballasts with several different cable lengths. If the distributor is out of stock for a unit with a short cable,,the buyer must settle for a more expensive one with a long cable.

The Shaeffer design violates at least ground rules 7 and 8. During handling, installation or replacement the weight of the ballast is likely to be inadvertently struck against the very large, expensive printed-circuit board—incurring the risk of damage to the board. As is well known, such damage is likely to be partially or entirely concealed and is likely to cause an electrical fault of the worst sort—namely, an intermittent one.

If proposed as an industry standard, it would also violate ground rules 4 through 6. Here, however, as contrasted with the Naysmith situation already discussed, the difficulty of using Shaeffer's ballast configuration in a conventional fixture would be essentially prohibitive. It is clear that Shaeffer's teachings are not intended to have any compatibility with existing or present standard fixtures.

Thus, as he explains, the electrical connections of his ballast terminate in an array of small connector pins in the coverplate. For use with a standard wiring harness, these pins would require some sort of mating connector added to the wire ends—or perhaps a solder joint.

Shaeffer does not address these possibilities, for the apparent reason that the connector pins would interfere with mounting of his ballast in a conventional fixture anyway. Plainly, use of that ballast in such a fixture would require far more than use of Naysmith's—i.e., more than merely cutting off and discarding expensive but unused components.

The Comer configuration too would violate ground rules 4 through 6, although in degree of incompatibility with earlier fixtures it is perhaps intermediate between the Naysmith and Shaeffer designs. In Comer's unit, some wires do extend out of the can, perhaps three to five centimeters, to his laterally mounted connectors; thus cutting off and discarding the connectors might possibly permit connection by means of wire nuts or the like to the stub wiring.

As will be evident, however, making connections to such short wires is difficult or at least awkward and annoying. In the course of the process a growing cluster of wire nuts would develop in a small region adjacent to the end of the can, requiring progressively greater dexterity and care to make each successive connection. Even removal of the Comer connectors and their mounting bracket—if indeed that were feasible without damaging the coverplate—would make available very little additional room for the new connections.

In addition Comer's ballast violates ground rules 1 through 3. The additional metal usage for the coverplate extension and connector bracket, and the hand-mounted individual connectors, would probably make Comer'design economically unfeasible.

Daniel Smith's ballast violates ground rules 4 through 6, for generally the same reason as Shaeffer's ballast. If anything, Smith's configuration is more problematic with respect to retrofit: his contact tabs appear probably even more resistant to adaptation for use in older fixtures than Shaeffer's pins.

The Crowe ballast is particularly interesting, since it is relatively similar in outward appearance to other modern designs (including the LUMINOPTICS unit). It is also interesting because Crowe's patent contains some important teachings which are followed by one other patented design, but which we regard as incorrect.

For most ballasts—more specifically, for magnetic ballasts and those relatively heavy electronic ballasts that have power-factor or radio-frequency-interference filters—the Crowe configuration violates ground rules 7 and 8. During shipping and handling, the weight of the ballast components is likely to crack the internal circuit boards, causing damage even more obscure than that discussed above with respect to Shaeffer's large external circuit board. Crowe's circuit board is even more subject to damage due to vibration.

Whether caused by handling damage or vibration, damage to the circuit board in a Crowe ballast is even more likely to be intermittent. His circuit board is more directly coupled to heat developed within the electrical components of the ballast, and therefore more likely to flex during warmup. Flexure might not occur, however, until heat accumulates to nearly a steady-state operation condition, perhaps an hour after the lamp starts.

We believe that Crowe's invention also violates ground rules 1 and 2, at least for fully potted ballasts. We have experimented with connectors mounted by a "window frame" kind of mounting, of the general sort employed in Crow's ballast, and found such mounting unacceptable. Problems with such mounts arise from the generally rough-work nature of the inexpensive sheet-metal forming procedures used in making ballast cans.

More specifically, we learned that the sometimes rough sheet-metal edges, and sometimes very substantial curvature of the metal, produced a much higher need for installation force than anticipated. When the window-frame grooves along the connector edge were widened to alleviate this problem in some units, then the fit was rendered loose or sloppy for other units that happened to be smoother or less curved.

Hence, if a window-frame mount is chosen to be relatively tight, extra assembly time and cost will often be required to force the connector into place—with caution needed to avoid slips that could cut the workers' hands on the metal edges. These operations could be particularly difficult in a ballast with a circuit board attached to each connector, as in Crowe.

On the other hand, if the mount is chosen to be relatively loose, then extra time and cost will often be required to wipe away the potting material that leaks around the edges of the connector in a loose mounting, In especially loose installations, our connectors actually floated upward in the potting material, as that material was poured, leading to what might be called "catastrophic leaks".

Thus, in summary, fit is critical in window-frame mounting. Special precautions of course could be taken to hold the connector in place, and perhaps also to press it firmly against the wall during initial stages of poring the potting material; but these precautions would be unacceptably costly in terms of labor.

In Crowe's configuration the connector cannot float out of place because it is secured to the circuit board; but we regard circuit boards as undesirable in most ballasts, for the reasons already discussed. Thus as noted above we consider picture-frame mounting to violate ground rules 1 and 2.

Crowe provides connectors that receive discrete leads from the wiring harness individually, rather than grouped leads held in a half connector as in Burton and in the Valmont XL Series. Crowe explains:

> "One . . . manufacturer has included an electrical connector . . . for interconnection thereto by a mating electrical connector. The disadvantage to having an electrical connector at the end of the discrete wires is that typically the fluorescent fixtures are not sold with a mating electrical connector. Therefore, the manufacturer of the ballast has to include both connector halves which increases the cost of the electrical ballast. Furthermore, the installer . . . must not only replace the ballast but also terminate the discrete wires of the lighting to the mating half of the electrical connector. When replacing the ballast, the user . . . must buy a ballast which also carries an electrical connector which is matable with the electrical connector of the first ballast installed."

For several reasons, we believe that Crowe is incorrect in this teaching. First, he fails to recognize the two enormous benefits of using an external connector, whether prewired by a fixture manufacturer or attached later by an installer of a replacement ballast:

(1) After the external connector has once been permanently installed on the wiring harness and the harness tested, all ballast installations thereafter (including both the initial installation and all replacements) are far easier and simpler.

(2) More importantly, after the first test of the combined connector and harness, all later ballast installations are also rendered virtually foolproof with respect to correct wire-to-pin correspondence.

This latter point is most crucial, since the time required to make individual-lead connections is not merely the time required to plug in a single connector multiplied by the number of leads; to the contrary, great care (entailing extra time) must be taken to ensure that each lead is being connected to the proper contact.

Secondly, Crowe overlooks the fact that for new fixtures—when ballast is sold on an OEM basis to the fixture manufacturer—that manufacturer will be willing to pay for the slight additional cost of the external half connector (partly offset by a small saving in labor cost for wiring and testing), in order to obtain the competitive advantage of being able to advertise especially easy ballast replacement.

Thirdly, turning now to use of a new-style leadless ballast for field replacement of older-style ballasts: there is a fallacy behind Crowe's assertion that the user must buy a replacement ballast that "also carries an electrical connector which is matable with the electrical connector of the first ballast installed."

What Crowe overlooks here is that, when a ballast meeting all the above-mentioned ground rules is introduced to the fluorescent-lighting industry, there may be greater reason to expect standardization of pin assignments and connector configurations. Thereafter all new ballasts would carry compatible connectors; Crowe's objections would then all die within one generation of ballasts.

Fourthly, also regarding new leadless ballasts used as field replacements, Crowe overlooks various possibilities for distributing the external half connector for use in field replacement. At first, of course, for a period of perhaps four to seven years virtually every leadless ballast sold for field-replacement use would require such an external half connector; therefore during that preliminary transitional period it would be simplest to include one external half connector (and its price) with every new replacement ballast.

After that, manufactures could make an external connector available to retailers for distribution separately as an "adapter", either at a nominal price or free upon request. These procedures, if judiciously timed, would limit the manufacture's added cost to, on average, a small fraction of the cost of one external half connector for older-style ballast that is replaced.

Fifthly, and still as to field replacements, Crowe overlooks the possibility that to "terminate the discrete wires . . . to the mating half" the installer need not necessarily do any more work than would be required to make individual connections to Crowe's internal connector! That is, the wiring provisions in the external half connector may be made of the poke-in-and-lock type.

Stripped discrete leads would then be simply inserted into the rear of the external half connector, just as is the case with Crowe's connector. The poke-in connections would be substantially permanent, but release cams could be included in the half connector for prompt correction of wiring errors.

Sixthly, Crowe fails to realize that providing for use of an external half connector is not necessarily the same thing as requiring one. That is, allowing for use of an external half connector can be made compatible with attachment of the wiring harness discrete leads to the can-mounted half connector individually.

In other words, the benefits of using an external half connector may be achieved while retaining the user's options to wire replacement ballasts without one. Parts of this strategy are shown by Burton, whose ballast design we shall discuss next.

Burton's ballast violates ground rules 1 and 2, because the geometry of the connector and of its centralized mounting is inherently subject to leakage. The reason for this vulnerabilility is that the can and the connector both have steps at their two lower corners.

At each step there is one horizontal segment and one vertical segment. In addition there is a third horizontal segment across the floor of the can.

If the tolerance of all five of these segment lengths, as established in the sheet-metal forming steps, is not held to perhaps ¾ millimeter (0.03 inch) or better, potting-material leakage is likely to be substantial. Ballast-can construction, however, for the necessary economies desired according to ground rule 2, is inherently of a coarse character; fine tolerances are rather beyond the norm—at least for a multisegment shape as required by the Burton geometry.

This is particularly so if one takes into consideration the great variation of bending properties and resilience in different material lots. Even apart from varying impurity content and the like, normal cold-rolled steel used in ballast cans is typically 0.66±0.88 mm (0.026±0.003 inch) in thickness: that tolerance of nearly twelve percent of course generates large variations in strength, resilience, etc.

Either inordinate labor cost must be incurred to hold unusually tight sheet-metal forming tolerances to avoid leakage, or extra labor must be expended in wiping away potting material after pouring. In either event, the Burton configuration also demands extremely careful positioning (or some other sealing technique) to avoid leakage at the abutment between the vertical face of the connector and the straight cut edge along the beveled-floor segment of the can.

The Burton ballast also violates ground rule 8, in Burton's provisions for routing wires of the harness from the centrally mounted connector in both directions along the ballast to the lamp sockets. Concededly, Burton's previously described ledges and cable clamps do impose some orderliness upon the wire runs.

Presumably this is an effort to avoid damage by pinching of stray leads between the ballast housing and the fixture casing. Burton's solution, however, appears to be counter-productive.

To the extent that the character of the clamps can be determined from the Burton patent, they appear to be metallic, and in fact unitary with the other portions of the ballast can. It would seem that using such clamps, likely with sharp edges, to secure wires along the ballast-can ledge actually creates a risk of damage to the wires or their insulation. The significance of such damage will be apparent.

Forming the clamps over the wires also represents an undesirable additional manufacturing cost—as violation of ground rules 1 and 3. Furthermore, the clamps make installation or replacement much more difficult.

Thus Burton's ballast violates ground rules 1 through 3, and 8. It does demonstrate, however—as mentioned earlier—that a ballast connector may be configured to receive wiring-harness leads either (a) as a group held in a connector, or (b) individually if the connector is unavailable.

Burton's wiring-harness carrier 66 serves virtually as a connector body, to hold the individual wires together in a standardized array that matches the contact array of the mating connector in the ballast. The system therefore provides both quick connection and the essential certainty of correct wiring, and so takes a step in the right direction with respect to ground rules 5 and 6.

The individual bare-wire ends held by Burton's carrier directly engage poke-in contacts of the connector that is mounted in the ballast. Therefore a person who does not have Burton's carrier can nevertheless insert the bared ends of individual or discrete wires directly into the same poke-in contacts, to attach an older-style fixture (which has no wire carrier) to the ballast.

Of course this is not as convenient as using an external carrier or connector body, but is as convenient as any other system for attaching wires individually—i.e., as convenient as earlier conventional systems using wire nuts, or using poke-in systems such as Crowe's. Hence Burton's connection system facilitates field replacement of old-style ballasts, as well as OEM installation.

Burton's apparatus shoes that the benefit of an external half connector may be kept while retaining the user's option to wire replacement ballasts without one. As Burton's patent fails to mention or even suggest this dual function, however, it is not clear whether Burton obtained this benefit intentionally or inadvertently; furthermore, the specific mechanics of his system are questionable on several grounds, as follows.

Burton's system uses poke-in contacts in the ballast-mounted connector. These poke-in wiring connections between the ballast and the wiring harness constitute the entire mechanical system for holding the harness to the connector.

That is, the wiring system is required to serve as its own strain-relief system. We consider such a confusion between the functions of electrical contact and mechanical integrity to be relatively undesirable industrial practice, implicating indirectly ground rule 8 above.

If excessive withdrawal force is applied to the wires while they are restrained by the poke-in contacts, the tangs inside the poke-in connector may damage the wire ends—either jamming them within the poke-in cavities, or weakening them so that they fail later under vibration, or possibly deforming them so that they cannot later make good contact with the poke-in contacts of another ballast.

Burton provides a "release comb" to disengaging all the poke-in contacts at once, to allow for removal of the external wires with their attached carrier. This release comb is relatively wide and short, and therefore appears susceptible to cocking and then binding in it guides, particularly if s user attempts to operate it after the ballast has been in operation under typical conditions of heat, accumulating dirt, and vibration for several years.

Burton's patent does not state whether the comb is stowed permanently in its guides ready for use in field replacement, or is to be kept nearby for such use. (If the former, the assembly sequencing must be selected to avoid potting the comb; and if the latter, the comb is likely to be lost before it can be used.) Whichever may be the situation, the user must first find the comb and otherwise see to its proper positioning—partially concealed above the wiring carrier.

The user must then try to slide the comb longitudinally, relative to the housing, in a short operating recess adjacent to the ballast-mounted connector: the release comb operates in cramped quarters at best.

Most draws of Burton's ballast arise at least partly from the centralized location of the connector. We therefore submit that such centralized mounting is undesirable.

As has been shown in discussion of the Crowe ballast, however, problems also arise in prior-art effects to mount a connector at an end (or at each end) of the can. This assertion is validated by consideration of the XL Series ballast, with its end-mounted connector.

That ballast appears to violate ground rules 1 through 7 presented above. We shall take these points in order.

Within the ballast can, the XL ballast apparently requires an additional, costly intermediate terminal block for strain relief, as well as custom-made and custom-assembled flat metal strips that serve as pins and intermediate connectors. Extra labor—which may appear partly as material cost, if the assembly is bought complete for OEM use—is also required to make connections at both sides of this terminal strip.

In potting, the XL ballast relies upon a pair of tapered or ratchet-type snaps to hold the connector flange against the inside of the end wall. This technique relies on controlled deformation of both the plastic snaps and the metal edges. Formed sheet metal, however, is subject to uncontrolled bending or warping, particularly near corners. Rolled and punched sheet-metal construction is inherently coarse.

Under these conditions, in our experience, the window will sometimes seem too wide to yield a reliable seal, and sometimes too narrow for the snaps to pass through, with a reasonable amount of force. In either event, the result is additional labor, extra attention for seconds or minutes—to either force the snaps in, or wipe away potting-material leakage later. Tolerances can be controlled to avoid these problems, but the cost of doing so is then objectionable.

The XL unit also uses additional current-carrying components, at least within the ballast housing. This too increases cost without clear advantage.

As ground-round rule 4, the extra terminal strip in the XL system also requires an additional assembly step, rendering the unit relatively incompatible with a standard assembly line. In addition the extra connection introduces undesirable electrical resistance, which can be significant especially in some so-called "rapid start" filament circuits that operate on as little as three volts.

Outside the can, the XL Series ballast fails to answer the challenge posed by Crowe: connection is possible only by means of the external half connector, with no mitigating provision for field replacement. The external half connector does not appear to be of an easy-to-wire (e.g., poke-in) type such as we have described above; and there is no suggestion in the XL Series literature of any arrangement for making the external connectors available to users separately for field replacement.

In addition, the previously mentioned reverse wire dress of the external connector can only serve as an invitation to damage during shipping, handling, or field replacement. With that we reach ground rule 7.

In view of all the foregoing it appears clear that the prior art has not yielded a fluorescent-lamp leadless ballast, or leadless-ballast-and-harness combination as appropriate to the context, that makes use of an external half connector for its very important benefits while satisfying all of ground rules 1 through 8. A long-felt need of the fluorescent-lighting industry—and of the users of fluorescent lighting—has thus gone unmet.

SUMMARY OF THE DISCLOSURE

In view of the eight "ground rules" stated above for ballast constructions, at least as long as sheet metal is used for ballast cans, we consider it very important to develop a configuration that is completely compatible or harmonious with the intrinsically rough nature of formed sheet metal. Based on lengthy experimentation with several mounting systems, we have come to recognize more fully how all of the conventional attachment techniques essentially fight the underlying charter of sheet-metal fabrication.

For example, in addition to the picture-frame and tapered-snap mounts discussed above, we have analyzed or experimented with rivets, pins, and lanced cans (in which thin metal stakes provide guide for a connector body). Through-fasteners generally require unacceptable extra operations; and the lance technique is subject to tolerance problems similar to those of the picture-frame and tapered-snap mounts.

Our invention avoids all these problems, by applying the resilience—and generally the rough defined dimensionality—of the sheet metal to help ease the insertion of a connector, and thereafter to help control its position, rather than opposing those properties as in other systems.

Our invention preferably also incorporates other techniques, introduced below, that provide strain relief, accommodate field-replacement problems, etc. Here too, we accomplish these objectives by making the most of what is necessarily present in the ballast—rather than by adding more pieces and introducing more complications.

With the foregoing informal introduction, we shall now proceed to offer a somewhat more rigorous discussion. Our invention has several major aspects—some encompassing apparatus, and other aspects encompassing procedures.

In a first major aspect of the invention, our invention is, in combination, a ballast and connecting apparatus for use in a fluorescent-lamp fixture. It includes at least one electrical winding, and plural electrical leads operatively connected to the winding, for carrying electrical power to and from the winding.

The apparatus also includes a housing or can, that has two generally upstanding side walls, generally enclosing the winding and leads. The housing has two ends.

Our reason for saying that the housing "generally" encloses the winding and leads is to make clear that the housing need not enclose the winding and leads hermetically, or even in all directions. For example, as will be seen with respect to some aspects of the invention, the housing—although it has two ends—need not have end walls.

The apparatus also includes an electrical half connector disposed at at least one end of the housing. It further includes, defined at each side of the half connector, respectively, an ear that extends laterally into association with one side wall, respectively.

Defined in each side wall, immediately adjacent to said one end of the housing, the apparatus includes a cutout notch. This notch is for receiving the connector ear that is associated with that side wall, to retain the connector in place longitudinally at the end of the housing.

Finally the apparatus in this first major aspect comprises plural individual electrical contacts formed from or operatively connected to ends of the electrical leads respectively. The contacts are fixed within the half connector, for making electrical connections outside the housing.

The foregoing may be a definition of this first major aspect of our invention in its broadest or most general form. Even this broad form of the invention, however, can be seen to resolve several of the prior-art problems which we have discussed earlier.

There is virtually no additional cost associated with this aspect of our invention: all the materials are necessarily present in any conventional ballast can which is fitted at one end (or both ends) with a connector.

In assembly, the connector is simply placed in position with its ears in the notches, which accordingly cooperate to locate the connector relative to the side walls. The ease of this step is relatively quite insensitive to the accuracy of the sheet-metal cutting or bending—i.e., of fabrication tolerances—within normal industrial practice.

No extra step must be added, and no otherwise desirable step must be omitted, to incorporate this procedure into a substantially conventional assembly line. The invention simply makes such a line operate more easily and quickly.

Furthermore, once the connector is emplaced the degree of accuracy of its positioning, relative to the walls of the housing, similarly depends very little upon such tolerances. Consequently a good seal can be made between the connector and housing, if desired. In any event the connector is well located relative to the housing, for purposes of placement in a jig or fixture for further processing—such as, for example, attachment of a coverplate and other features that permanently secure the connector in place.

With regard to field-retrofit use, the ballast according to this first aspect of our invention in its broadest form is readily interchangeable with earlier ballasts that have integral leads—provided only that suitable arrangements are made for attachment of the external wires in the fixture to the ballast connector. Such arrangements will be taken up again later in this document.

The simple shapes and interfitting of parts, in the first aspect of our invention as so far described, also introduce no fragility. Furthermore they introduce no new element that could damage other parts of the ballast.

This first aspect of our invention even in its broadest form therefore satisfies all of the earlier-introduced ground rules 1 through 8. This economical, simple geometry thus turns to advantage the inherently coarse character of the ballast-can construction, to yield (1) easy, stable and accurate positioning of the connector relative to the can walls, and (2) a good seal around the connector, including the areas near the ears and notches, for potting.

We prefer, however, to practice the first aspect of our invention with certain other features or characteristics that appear to optimize its performance and benefits. For example, we think it best that each notch be defined in an upper corner of the housing, at the top edge of the corresponding side wall.

In such a construction the connector simply hangs "by its ears" from the notches in the top edges of the side walls, in a particularly stable way. We also prefer that each ear extend upward to substantially the level of the top edge of the corresponding side wall.

The first aspect of our invention is particularly advantageous when the winding, leads, and internal portions of the half connector are potted within the housing by pouring of liquid potting material that solidifies around them. In this context, the notches cooperate with the ears to locate the connector firmly against the end of the housing and deter the potting material, while that material is liquid, from leaking out of the housing.

We also prefer to make the housing so that it has at least one end wall, at the same end of the housing as the half connector; and to define an orifice in the end wall of the housing. In addition we prefer to dispose the connector at least partly within the housing at the orifice, and firmly against the end wall to deter the potting material from leaking through the orifice.

In that preferred structure it is advantageous if the electrical connector protrudes through the orifice. Such a configuration serve to further retain the half connector in place and deter the connector from floating, in the liquid potting material, out of position.

In conjunction with the first major aspect of our invention—particularly when there is a plurality of electrical wires, extending through the fixture but substantially all outside the ballast housing—we prefer to provide a second electrical half connector. This second half connector is for holding the outside electrical wires, for making electrical connection between wires and corresponding contacts in the first half connector, respectively.

This combination preferably includes hook means, with a ratchet action, for locking the second half connector in engagement with the housing or in engagement with the first half connector. It also preferably includes manually operable release means, for releasing the hook means to disengage the half connectors from each other.

Several other preferred features or characteristics, which we consider it desirable to practice in conjunction with the first aspect of our invention, will appear from later portions of this document. In particular, we prefer to practice all of the several major aspects of the invention together.

A second major aspect of our invention is a procedure for fabricating a fluorescent-lamp ballast. As will be seen, the procedure is closely related to the first (apparatus) aspect of the invention. The procedure comprises the steps of:

(1) preparing at least one electrical winding, with plural electrical leads operatively connected to carry electrical power to and from the winding;

(2) preparing a housing, for enclosing the winding and leads, that includes two generally upstanding side walls, the housing having two ends; this housing-preparing step includes the substep of defining a cutout notch in each side wall, immediately adjacent to an end of the housing;

(3) forming from or operatively connecting to ends of the electrical leads, respectively, a plurality of individual electrical contacts;

(4) preparing an electrical half connector that defines, at each side of the half connector respectively, an ear for extending laterally into association with one side wall, respectively; this connector-preparing step includes fixing the contacts within the half connector for use in making electrical connections outside the housing; and (5) then positioning the winding and leads within the housing and positioning the electrical half connector at one end of the housing, with the ears inserted into the cutout notches, respectively.

These five steps may constitute a description or definition of the second major aspect of our invention in its broadest or most general form. This method satisfies all the previously discussed ground rules for ballasts, generally as pointed out in connection with the first major aspect—but with particular emphasis on the assembly-line and related labor-cost considerations of ground rules 4, 3 and 1.

In particular—because of the notches introduced in step (2) and ears introduced in step (4) of the procedure just described—the critical step (5) is characterized by ease, simplicity and effectiveness in assembly that are not available in any prior assembly method. As with the first aspect, however, we prefer to practice the second aspect of the invention with certain other characteristics or steps that optimize the beneficial results of the procedure.

For example, we prefer that the housing-preparing step comprise biasing the side walls outward; and further comprise the additional step of—after the positioning step—moving the side walls inward, against the outward bias.

We also prefer that the procedure further comprise two subsequent steps: (a) while the side walls remain inward, pouring liquid potting material into the housing around the winding, leads, and internal portions of the half connector; and (b) then permanently securing the side walls moved inward. In this event we prefer that, during the pouring step, and thereafter while the potting material remains liquid, the notches cooperate with the ears to retain the half connector in position at the end of the housing and deter the potting material from leaking out of the housing.

In addition we consider it preferable that the housing-preparing step comprise forming the housing with at least one end wall, at the same end of the housing as the half connector, and defining an orifice in the end wall of the housing. Here we prefer that the positioning step comprise disposing the half connector at least partly within the housing at the orifice, and firmly against the end wall to deter the potting material from leaking through the orifice.

In this last-mentioned instance, it is preferred that the connector-disposing step further comprise inserting the electrical connector to protrude through the orifice. Such protrusion is advantageous to further retain the half connector in place—and deter it from floating, in the liquid potting material, out of position.

We also find it advantageous if the housing-preparing step comprises biasing the side and end walls outward. In this case it is best that the procedure further comprise the additional step of—after the positioning step but before the pouring step—moving the end wall and side walls inward, against the outward bias.

The end wall then longitudinally engages the connector and closely captures the ears in the notches; and the side walls closely approach edges of the end wall. The result is that leakage of the potting material through the orifice, or through the notches, or between the end wall and the side walls, is deterred.

In the method as just described, we prefer that the wall-moving step comprise placing the housing, with the winding, leads and connector, in a fixture that holds the side and end walls inward. We also prefer to include the subsequent step of permanently securing the walls moved inward—as, for example, by affixing a cover that engages and holds the walls.

Before the walls are moved inward, and before the pouring step, the end wall resiliently engages the connector longitudinally. In this way it facilitates assembly by retaining the half connector in place.

We prefer that the half-connector-preparing step comprise forming each ear so that in the positioning step the ears will extend upward to substantially the level of the top edge of the corresponding side wall. This deters the liquid potting material from leaking out of the housing above the ears.

A third major aspect of our invention, usable independently of the others but preferably practiced in conjunction with them, is—like the first—a combination of a ballast and connecting apparatus for use in a fluorescent-lamp fixture.

This combination includes at least one electrical winding; and plural electrical leads operatively connected to the winding, for carrying electrical power to and from the winding. It also includes an electrical half connector.

The combination further includes plural individual electrical contacts, formed from or operatively connected to the electrical leads respectively. The contacts are fixed within the half connector, for making electrical connections between the leads and such a fixture.

Material of the half connector is displaced by fracture, substantially without flow, into or around the leads or the contacts to hold the leads or the contacts within the half connector. In this way strain relief is provided for each contact without using any additional component.

From what has already been said about this third major aspect of the invention, it can be seen to significantly enhance compliance with the previously enunciated ground rules for ballasts—particularly the first three rules. This aspect of our invention provides necessary strain relief at zero material cost.

It requires just one simple mechanical assembly step, one that is readily automated. That step occurs in a preliminary part of the assembly procedure, when there is ample room for placement of the necessary equipment and manipulation of the partial assembly.

Plastic materials are most suitable for use in molding a half connector for use in our invention. Such materials are conventionally displaced, in plastic-welding processes and the like, so that they merge or blend with electrical-wire insulation.

In conventional procedures, such displacement has been used for general positioning purposes and for strain relief. By our above phrase "without flow" we mean to distinguish such known uses.

To be effective for our purposes, the material of the half connector must deform by processes that may be described by words such as "snap", "break", or "fracture", rather than "flow"; that is, the material must be displaced while it is relatively brittle. It must not, however, be too brittle—lest an entire region of the structure near the displacement region shatter, destroying the structural integrity of the half connector and also thereby introducing various other problems.

One alternative way of articulating this third aspect of our invention is to say that the displacement is by fracture substantially without heating (rather than without "flow"). The reference point here is the ordinary range of room temperatures in a mechanical processing or assembly area.

That is to say, even though an assembly-line facility may be heated—as for comfort of workers—our invention may still be practiced in such a facility. Displacing material of the half connector without further, localized heating in such a facility would be within the scope of our invention as here described.

There is still another way of articulating this third major aspect of our invention. This other mode of expression does not rely upon the concepts of fracture without flow, or without heating; however, it is more specific than the first two as to mechanics. It relates to a form of the third aspect of the invention that we have found to be outstandingly effective.

In this formulation, or articulation, the apparatus includes—in addition to the winding, leads, and contacts mentioned earlier—an electrical half connector that defines a plurality of passageways. The passageways are for receiving the plural leads, respectively, near their ends; each passageway has a respective interior wall.

Material of the half connector is displaced to form plural pieces of said material that are wedged between the leads and the corresponding passageway walls, respectively. They thus serve to hold the leads within the second half connector, so that—as before—strain relief is provided for each lead without using any additional component.

We prefer that the pieces be broken from the half connector at an angle less than thirty degrees, such as very roughly fifteen degrees, off the perpendicular to the passageways, respectively. Each piece accordingly has a corresponding angled shape, which particularly facilitates and enhances the wedging action described above.

In a fourth major aspect of our invention, related to the third, analogous strain-relief results are obtained by fracture and displacement of material in a half connector—but an external one, that mates with the half connector which forms part of the ballast. Thus our invention can be used in either half connector, or both.

A fifth major aspect of our invention is, in combination, a ballast and connecting apparatus for use in a fluorescent-lamp fixture that has lamp sockets. The combination is for attachment to such sockets selectively either (a) by discrete electrical wires attached to the ballast individually or (b) by a group of electrical wires held in an electrical half connector, if available, that is external to the ballast.

The combination includes at least one electrical winding; and plural electrical leads operatively connected to the winding, for carrying electrical power to and from the winding.

It also includes an internal electrical half connector adapted to mate with such an external half connector if available. In addition it includes plural individual electrical contacts, operatively connected to the electrical leads respectively, and fixed within the half connector for making electrical connections between the leads and the electrical wires.

Each contact is a female element of resilient conductive material, formed into a generally circumferential conductive socket. Each socket directly receives, generally encircles, and makes a good wiping contact with a bared end of an electrical wire, respectively.

The sockets as a group are arrayed to receive bared wire ends held in an external connector of a certain configuration. Connection therefore can be made either with such an external connector or without one. Thus the combination is useable for replacement of old ballasts even if an external half connector is not available.

Important to this fifth major aspect of our invention is the circumferential or cylindrical character of the female contacts, and the smooth wiping contact that they make with the bared wire ends. This refinement preserves the advances introduced by Burton—while avoiding wire damage that otherwise could lead either to failure in service or to serious difficulty in connecting a new ballast several years later.

As before, the foregoing may constitute a definition or description of the fifth major aspect of our invention in its broadest or most general form, but we prefer to incorporate other elements or characteristics. In particular we prefer that the combination also include the external electrical half connector—including an external connector body.

That body, if included, holds all of the electrical wires with the bared metal ends in relative positions to directly engage corresponding contacts in the internal half connector. In addition, the external connector body slides smoothly into and out of engagement with the internal half connector.

The wires slide smoothly into and out of engagement with the contacts, respectively. They do so without interference by any device that locks wires individually into engagement with individual contacts.

We prefer also to include some means, not acting through the wires or contacts individually, for releasably securing the body of the external connector to the internal half connector. Advantageously such means include at least one ratchet-like hook fixed with respect to one of the half connectors, for releasably engaging an element that is fixed with respect to the other half connector.

All the foregoing operational principles and advantages of the present invention will be more fully appreciated upon consideration of the following detailed description, with reference to the appended drawings, of which:

BRIEF DESCRIPTION OF THE DRAWINGS

FIG. 16 a bottom plan of the same receptacle.

FIG. 17 is a front (i.e., inward-facing) end elevation of the jack, or external half connector, of the FIG. 10 embodiment.

FIG. 18 is a rear (outward-facing) end elevation of the same jack.

FIG. 19 is an elevation in longitudinal section, taken along line 19—19 in FIG. 17, of the same jack.

FIG. 19A is a like detail view, considerably enlarged, of a hook-tip portion of the same jack.

FIG. 19B is a like view, similarly enlarged, of a contact-seating and -retaining portion of the same jack.

FIG. 20 is a top plan, partly in longitudinal section, of the same jack.

FIG. 32 is a perspective view, more schematic but greatly enlarged—showing a single lead or wire, and a single tool, that form part of the same connector and tooling.

FIG. 33 is a schematic longitudinal section showing initiation of material displacement in the same connector by the same tool.

FIG. 34 illustrates provision of strain relief for an insulated wire or lead, showing completion of material displacement for the same connector and tool.

FIG. 42 illustrates provision of strain relief for a contact that terminates a wire or lead—rather than for the wire or lead directly.

DETAILED DESCRIPTION OF THE PREFERRED EMBODIMENTS

Lamp sockets 1, 2 (FIG. 1) may be considered as part of the context or environment of our invention, or to the extent recited in certain of the appended claims may be elements of the inventive combination. The same is true of the external half connector 70, the power supply wires 6, the external wiring 3, 5 from the sockets 1, 2 to the ballast 10/40, and the cross-connections or common wiring extensions between the parallel-wired sockets 1.

Figure 1:
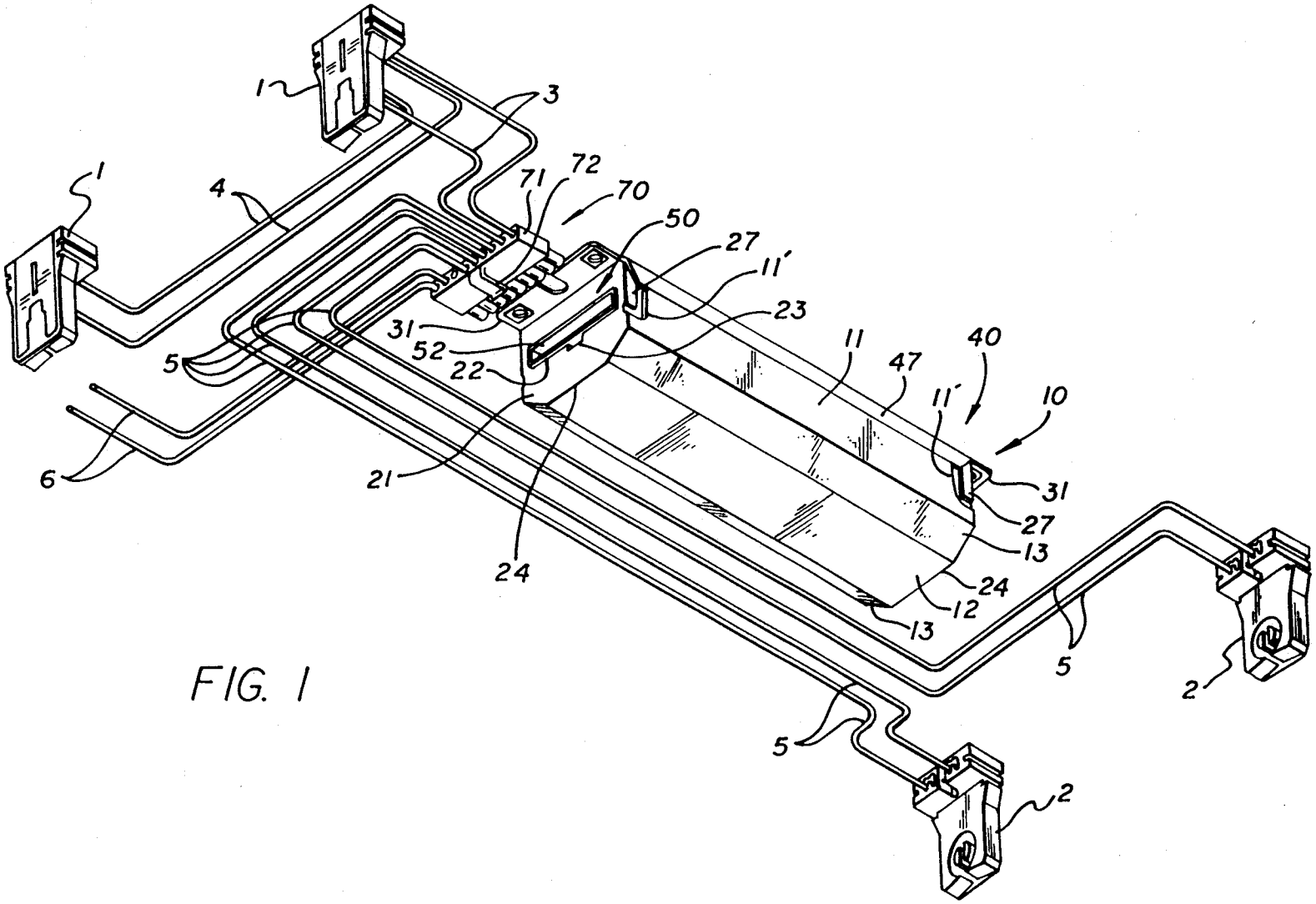
FIG. 1 is a partly schematic perspective or isometric view, taken from below, showing a preferred embodiment of a ballast and connecting apparatus according to our invention, together with lamp sockets of a fluorescent fixture. This embodiment has a connector at only one end of the ballast can.
Figure 2:
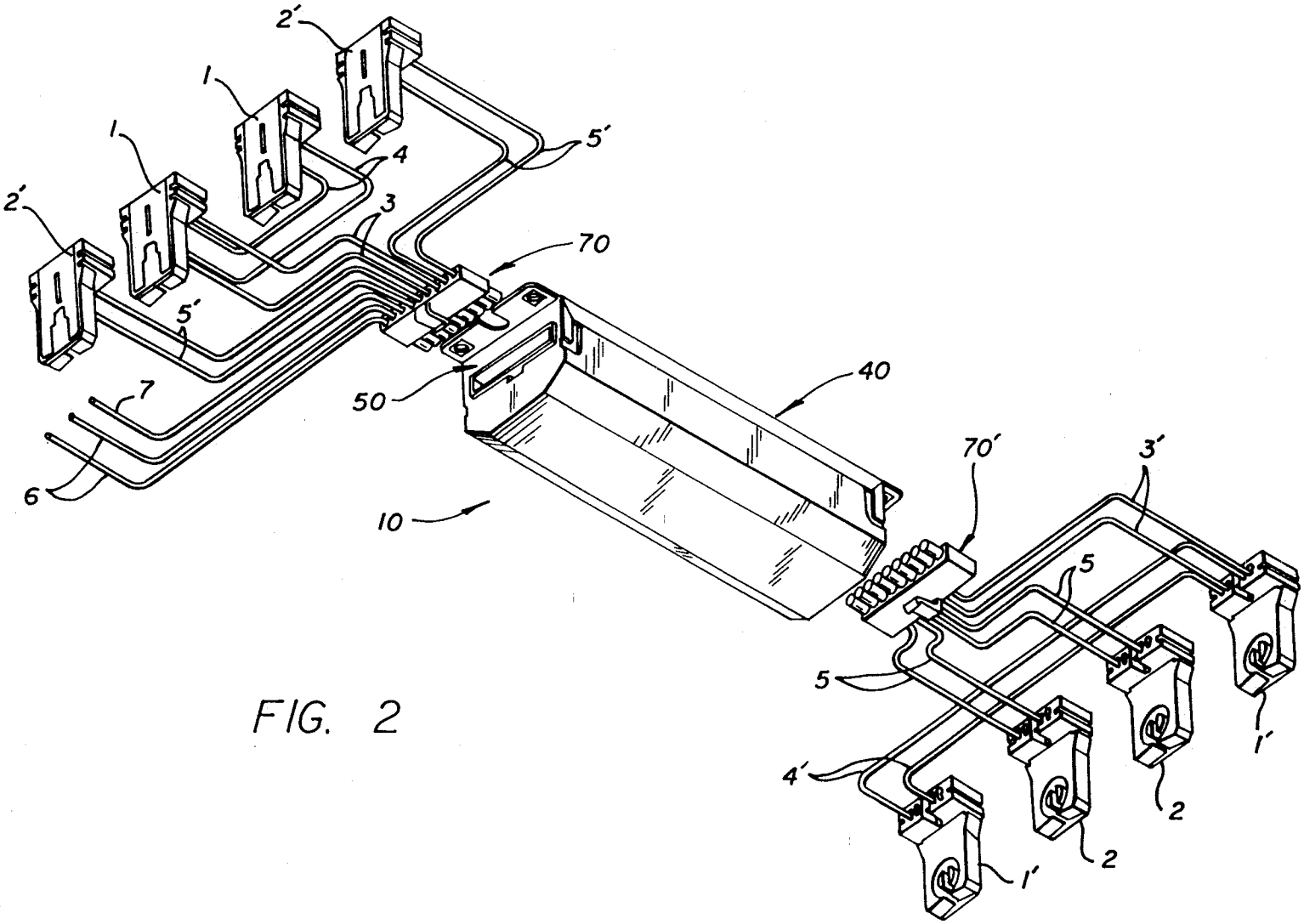
FIG. 2 is a similar view showing another preferred embodiment that has a connector at each of the two ends of the ballast can, respectively.

The system of FIG. 1, with its single connector 50/70, includes sockets 1, 2 for two lamps; and the connector has one unused wiring position. FIG. 2 illustrates a system with two connectors—one at each end of the ballast—and with sockets 1, 2, 1', 2' for four lamps. This FIG. 2 system includes additional direct ballast-to-socket wires 3', 5' and additional cross-connections 4'.

If the ballast is an electronic type, the external wiring may include an added wire 7 to a computer or to a manual control for light intensity or the like—thus using all nine wiring positions in one connector 50/70 that carries the input power and control connection. The connector at the other end of this ballast, however, has three unused positions.

If justified by production volume, connectors with fewer wiring positions may be substituted for those having some positions unused, in both FIGS. 1 and 2. A countervailing consideration is the cost of the added tooling required.

As shown in FIGS. 1 through 9, the ballast can or housing 10/40 is made up of two main parts: a lower structure 10 and a coverplate 40. Each is made from a single formed piece of sheet metal respectively.

The lower structure 10 includes two generally upstanding side walls 11, continuous (along a corresponding fold 15 at each lower edge) with a pair of transitional angled panels 13, respectively. Each of these angled panels 13 in turn is continuous (along a respective fold 14) with a common central floor 12.

Continuous with the floor 12, along a transverse fold line 24 at each end, is an end wall 21. In the illustrated embodiment, each end wall 21 is in turn continuous along another transverse fold line 32 with an end segment 31, and along a pair of longitudinal fold lines 28 with a pair of short side tabs 27, respectively.

Figure 4:
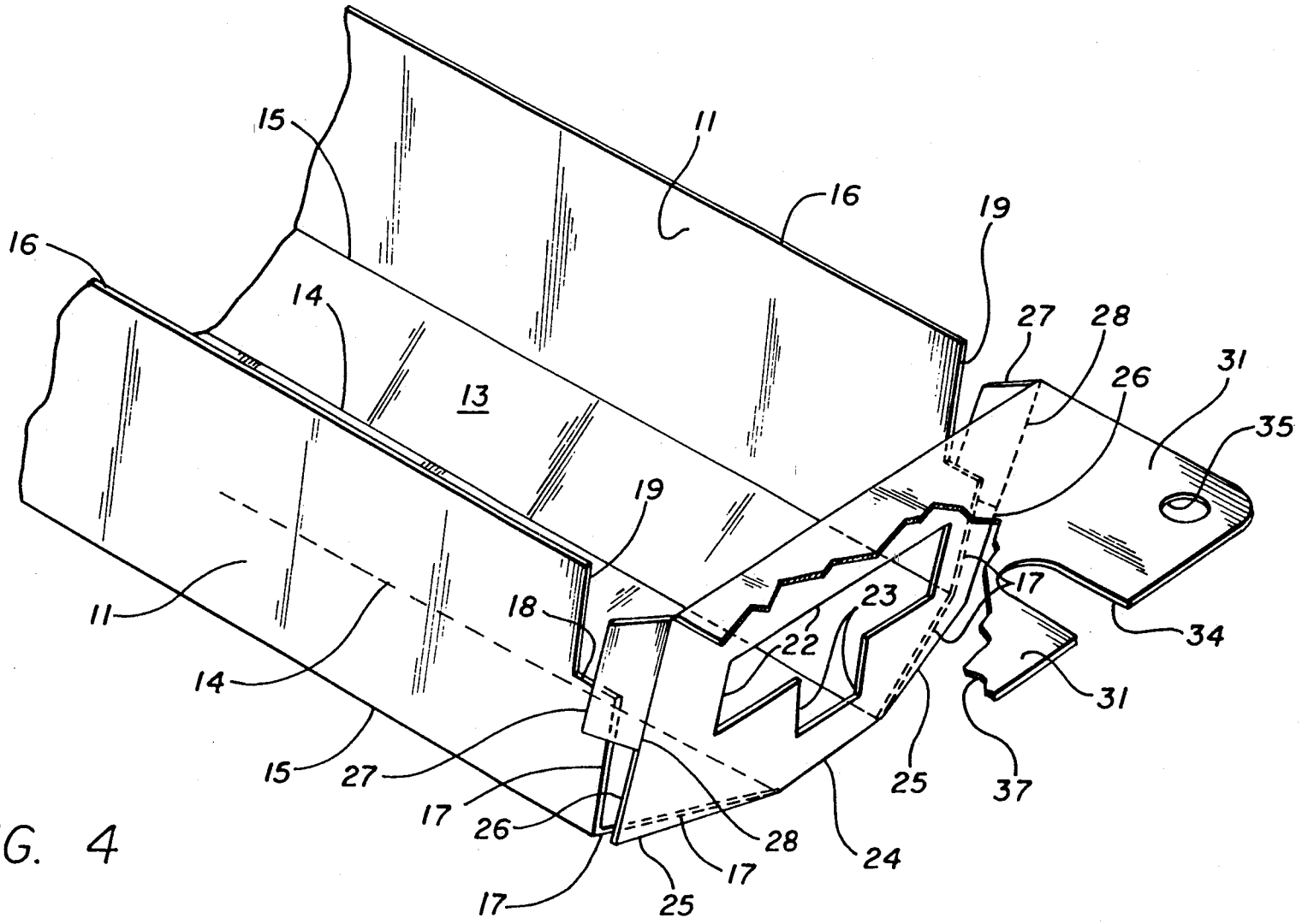
FIG. 4 is a like view of the same can at a later stage of forming, with the end wall of the can bent up and resiliently biased longitudinally outward—and with a horizontal end segment of the can also bent to extend longitudinally outward from the vertical end wall. That longitudinally extending horizontal end segment is drawn partially broken away, for a better view of the vertical end wall.

After assembly, as seen in FIGS. 1 and 4, both of the latter longitudinal fold lines are generally vertical, while the end segments 31 are generally horizontal and extend longitudinally. As explained elsewhere in this document, we believe that our invention encompasses embodiments having no vertical end wall 21, no side tab 27, and no horizontal end segment 31.

The side tabs 27 (when present) then extend longitudinally from the side edges 28 of the end walls 21, along the outside surfaces of the side walls 11 respectively. Analogous side tabs 47, much longer than those of the end walls 21, extend downward from fold lines 48 along the long edges of the coverplate 40—also along the outside surfaces of the corresponding side walls 11.

For best inside clearance each side panel 11 is enlarged or "bellied out" in an area that is below (as in FIG. 1; or within, as in FIG. 8) a tapered step 11' formed in the sheet metal of the side panel. The step 11' may meander somewhat arbitrarily, as suggested by comparison of FIGS. 1 and 8.

Figure 8:
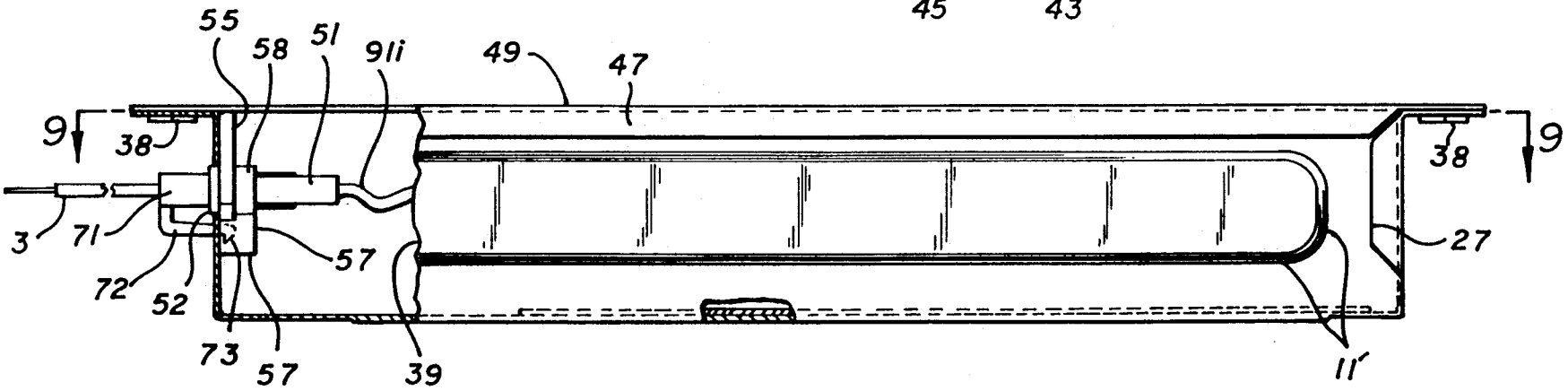
FIG. 8 is a side elevation showing the coverplate in place and holding the walls inward, on the finished can of the FIG. 1 embodiment.

The end segments 31 are preferably formed with holes 35 for use in connection to the coverplate 40 (FIG. 7), at matching holes 45 in that plate—as by fasteners 38 (FIG. 8). The end segments 31 and 41 of both the lower structure 10 and the coverplate 40 are slotted 34, 44 for attachment by suitable fasteners to a luminaire (not shown).

Die-cut into each side wall 11, at each end 17 of the side wall 11 where a connector is to be installed, is a respective notch 18/19. Each notch includes a vertical edge 19, longitudinally inset from the corresponding side-wall end edge 17; and also includes a longitudinal bottom edge 18.

In the preferred embodiment illustrated, each notch 18/19 is cut out of the upper corner of the corresponding side wall 11 (although, as explained elsewhere, that limitation is not believed to be necessary). Thus the notch has no upper edge as such, and the longitudinal bottom edge 18 of the notch is simply inset or down-set below the upper edge 16 of the corresponding side wall 11.

Die-cut in each end wall 21 (when present) that will carry an internal half connector 50 is a respective orifice 22/23. The orifice has an upper, relatively large rectangular portion 22, and a smaller slot or recess 23 communicating with the bottom center of the large portion 22.

In the preferred embodiments that are illustrated, the internal half connector 50 is mounted substantially just inside the corresponding end wall 21. We use the term "substantially" here to allow for the slight protrusion of an outward-projecting circumferential flange 52 from the internal half connector body 51/58, through the large upper portion 22 of the end-wall orifice 22/23.

The external half connector 70 includes a body 71, to which all the external wires 3, 5, 6 are connected. In the preferred embodiments of FIGS. 1, 2, 5, 6, 8 and 10, the internal half connector 50 is a receptacle and the external half connector 70 is a jack.

Figure 11:
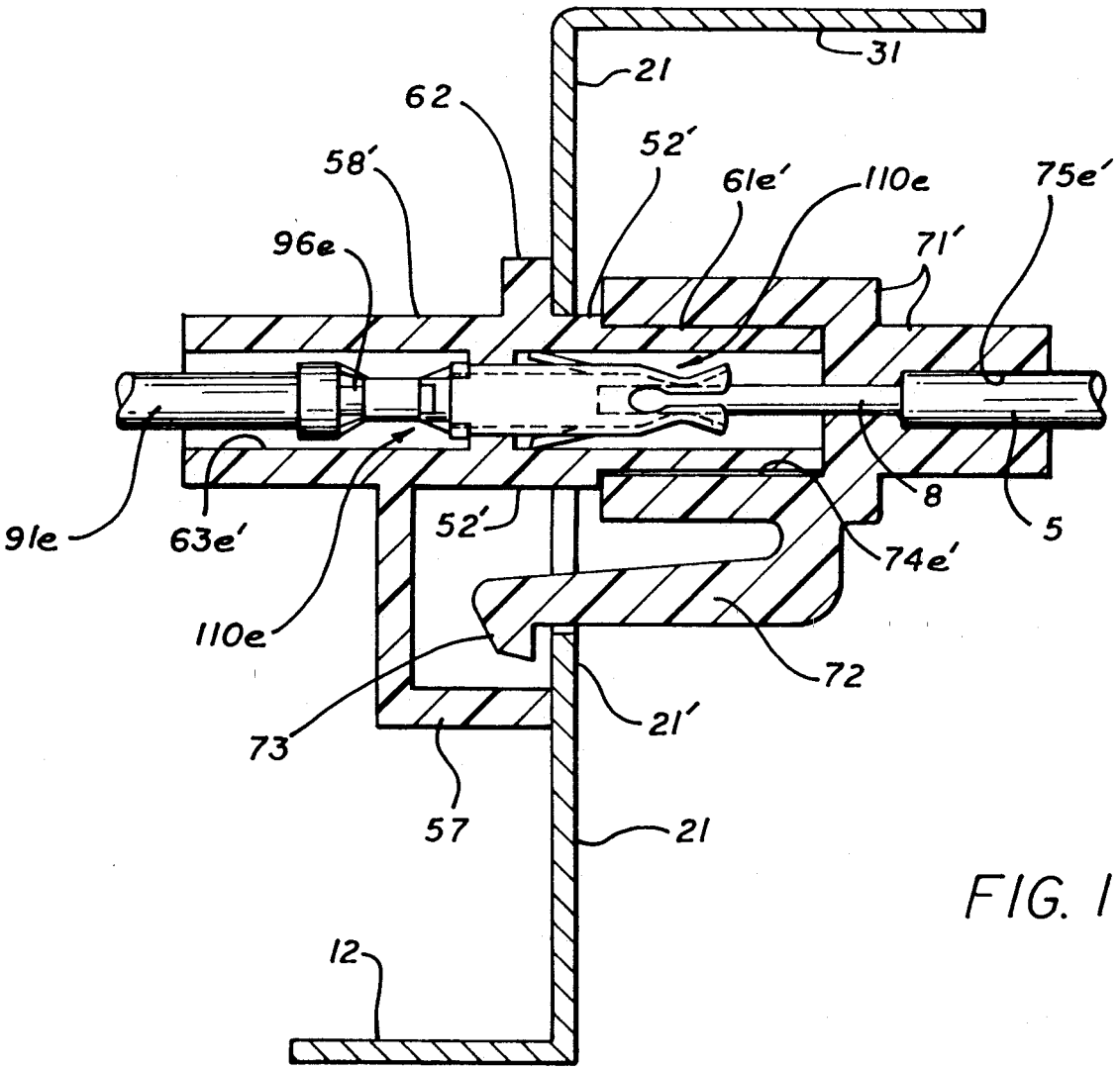
FIG. 11 is a like view for another preferred embodiment of our invention.
Figure 12:
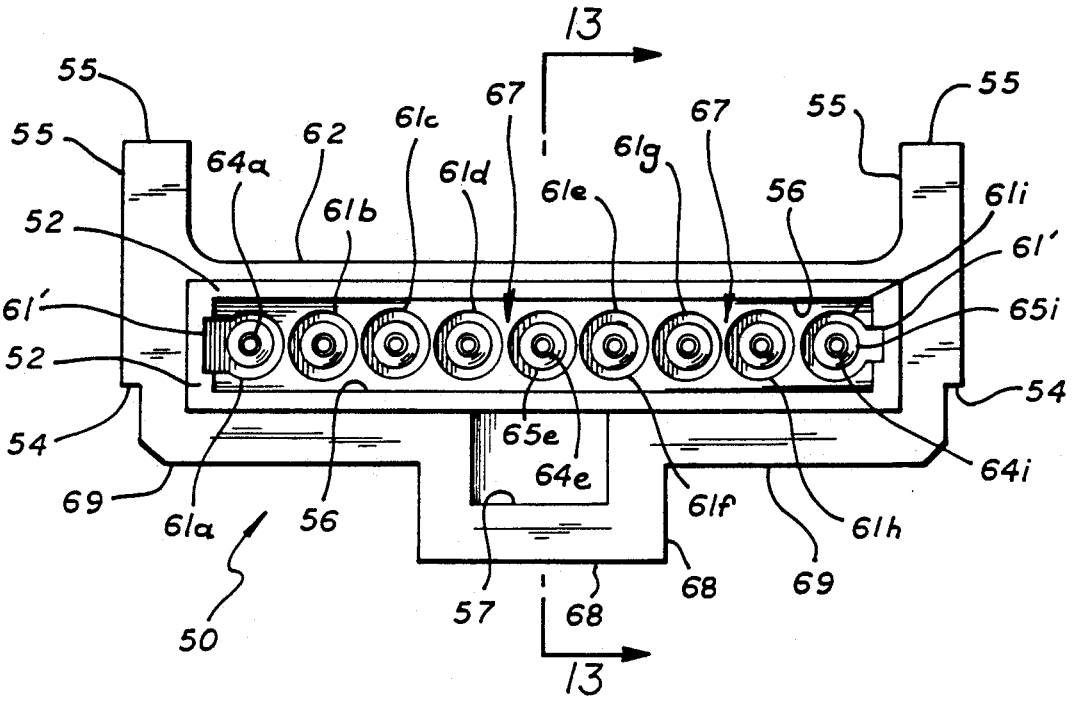
FIG. 12 is an outside end elevation of the receptacle, or internal half connector, of the FIG. 10 embodiment.

Thus, when the external half connector 70 is mated with the internal half connector 50, the forward tip of the external half 70 is inserted into an outward-facing antechamber 56 formed within and by the circumferential flange 52. In other preferred embodiments, however, the opposite relationship may be used, as shown in FIG. 11.

In either event, a hook 72 that projects from the external half connector body 71 then protrudes through the small recess portion 23 of the orifice 22/23 in the end wall 21, and into a small secondary cavity 57 (see FIGS. 5, 6, 8, 10 and 11) formed with the internal connector body 51/58.

In assembly of the preferred embodiments illustrated in FIGS. 1 through 10, typically the lower structure 10 and coverplate 40 are first die-cut from flat sheet metal. Then the side walls 11 and transitional angled panels 13 are bent upward from the floor 12 to the orientations generally shown in FIG. 3.

As previously mentioned, the end wall 21 is continuous with the floor 12, the end segment 31 and the short side tabs 27—along respective fold lines 24, 32 and 28. Those fold lines thus form part of the demarcation of the end wall 21.

The remaining demarcations of that wall are formed by substantially vertical cut side edges 26, below the short tabs 27, and angled cut lower-transitional edges 25. The end wall accordingly has a double-trapezoidal shape, whose two angled lower edges 25 after bending lie generally adjacent to the cut edges of the two angled transitional panels 13.

As this bending process is completed, but before the metal break or other tooling is released, the long-fold angles 14, 15 are such as to add up to substantially a right angle; in other words, each of the walls 11 is then substantially perpendicular to the common floor 12. Similarly the side tabs 27 are then bent to a right angle, or slightly past a right angle, relative to the end walls 21.

Finally right angles are formed along a short fold line 24 where the floor 12 is continuous with the end wall 21, and at a longer fold line 32 where that wall 21 is continuous with the end segment 31. Because the metal is resilient, however, when the tool releases the metal all these bends spring open slightly from their final angles as formed.

Then the side walls 11 and end wall 21 all angle slightly outward from the vertical, relative to the floor 12. The overall result of the bending action and the reaction just described appears in FIG. 4.

Figure 5:
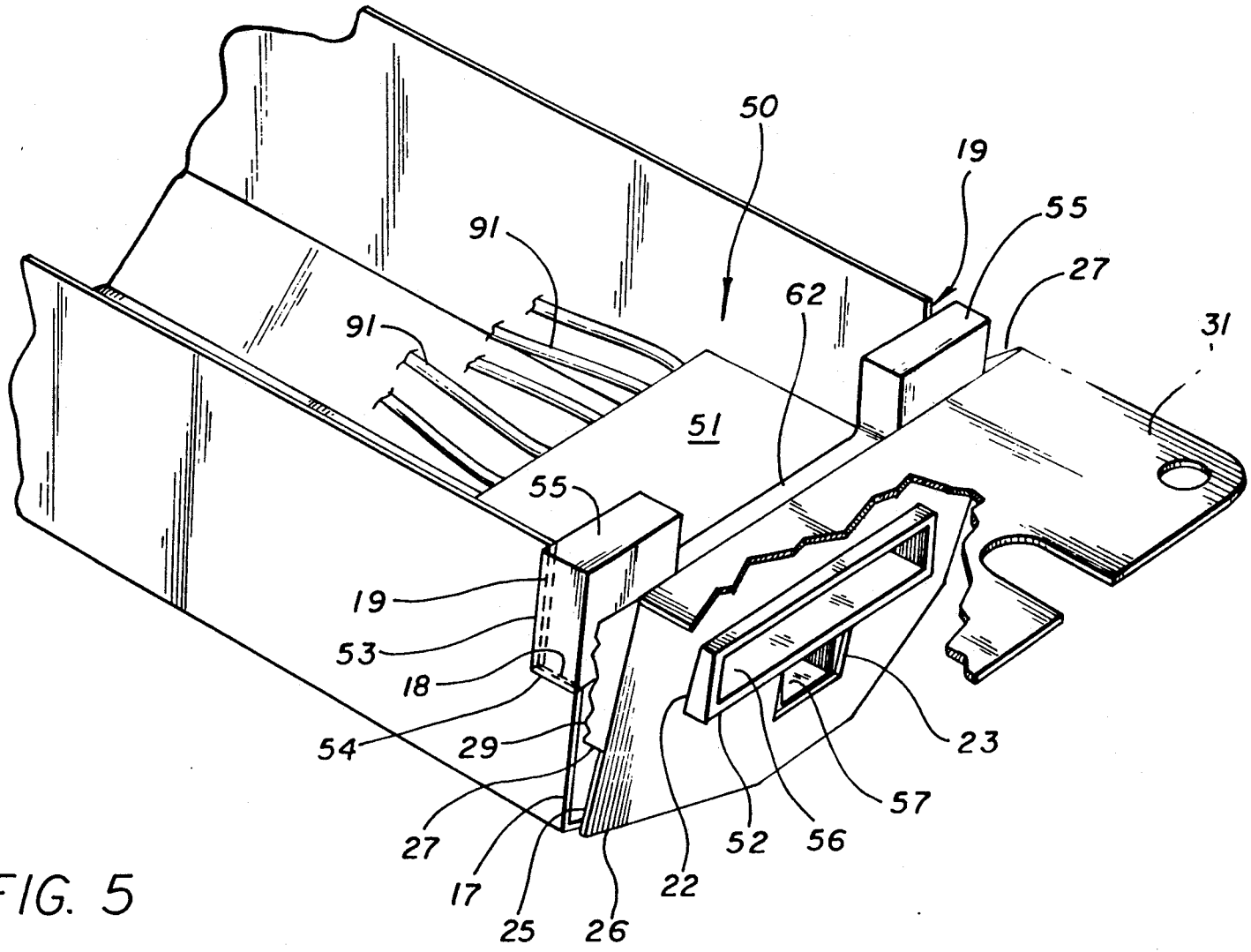
FIG. 5 is a like view showing the internal half connector preliminarily positioned.
Figure 6:
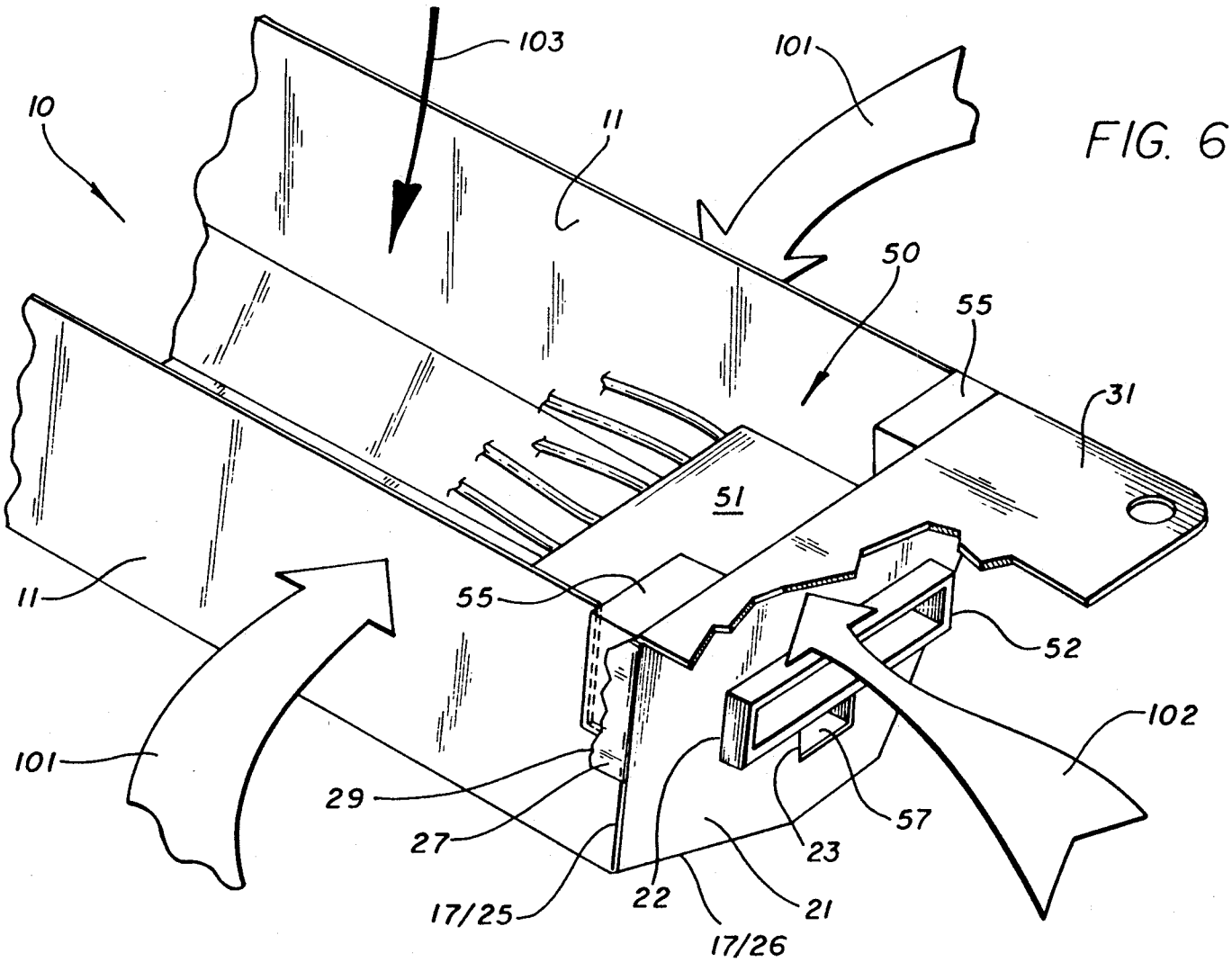
FIG. 6 is a like view showing the walls moved inward against their outward bias to bring the half connector to its final position, and potting compound being poured.
Figure 7:
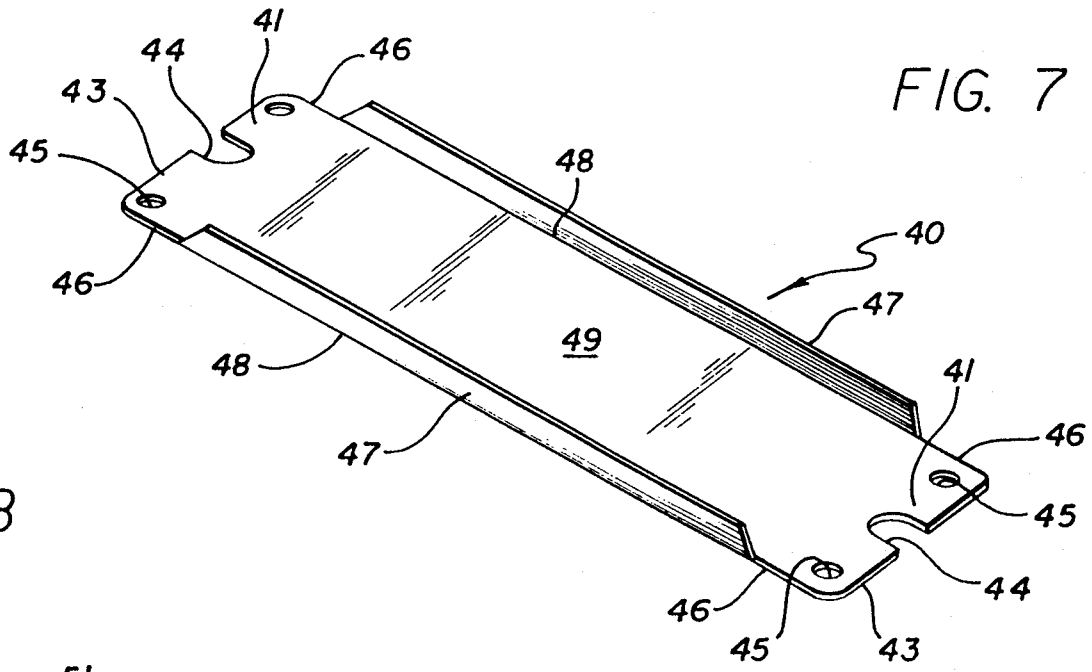
FIG. 7 is a like view of a coverplate (shown inverted) for the embodiment of FIGS. 1 through 6.

In FIGS. 4 and 5 the springback has been drawn exaggerated to permit a more definite view of the consequent clearances. In FIGS. 4 through 6, the end segment 31 is drawn partially broken away at 37 for a clearer view of relationships between other parts.

FIG. 4 shows, in particular, a gap between the end edges 17 of the two intermediate angled panels 13 and the nearly adjacent angled lower edges 25 of the end wall 21, respectively. This gap is narrowest just adjacent to the floor folds 14, and widest at the outer corners formed by the end-wall angled edges 25 and vertical edges 26.

Also shown in an even wider gap between the end edges 17 of the two side walls 11 and the adjacent side edges of the end wall 21. (These side edges are formed, as earlier noted, by cut edges near the bottom of the end wall 21, and then by folds 28 nearer the top of the end wall 21.) This gap continues to increase from the bottom toward the top, due to the outward angles of both the end wall 21 and side walls 11.

The short side tabs 27, folded from the end-wall 21 side edges 28, project longitudinally next to the outside surfaces of the side walls 11, respectively—and in particular next to the notches 18/19 cut in the upper end corners of the side walls 11. Thus the tabs 27 partially obstruct the openings constituted by the notches 18/19.

Figure 9:
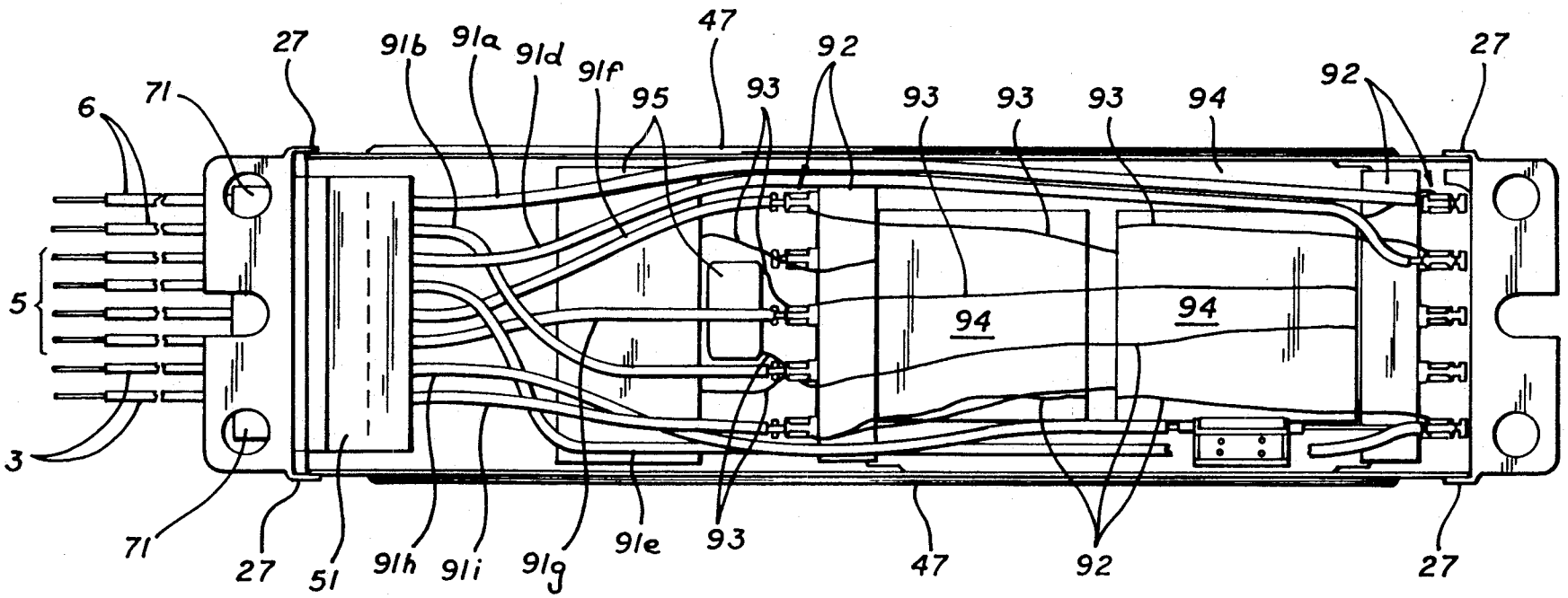
FIG. 9 is a plan view of the same finished can, taken along the line 9—9 in FIG. 8—i.e., with the horizontal main panel of the coverplate cut away—and showing the components within the can.

FIG. 5 illustrates the next assembly step, which is to drop roughly into place the internal half connector 50, with its attached internal leads 91 and their associated electrical components 92 through 95 (FIG. 9). In FIG. 5 one of the side tabs 27 is drawn broken away at 29, for a clearer view of the relationships between the parts of the internal half connector 50 and the sheet-metal parts already described.

The internal half connector 50 has a body 51/58, and an end-wall-abutting lip 62 (FIGS. 10 and 11) that extends upward from the forward or outward portion 58 of the half-connector body 51/58. The lip 62 restrains the body 51/58 from falling forward through the end-wall orifice 22, while allowing the previously mentioned circumferential flange 52 to protrude slightly through the orifice.

The internal half connector 50 also has a pair of ears 55 that extend upward from the flange 62, and thus indirectly from the body 51/58. When the internal half connector 50 is preliminarily emplaced, these ears 55 slide loosely downward into the corresponding notches 18/19—roughly guided, laterally, by the short side tabs 29 at both sides of the assembly.

Figure 3:
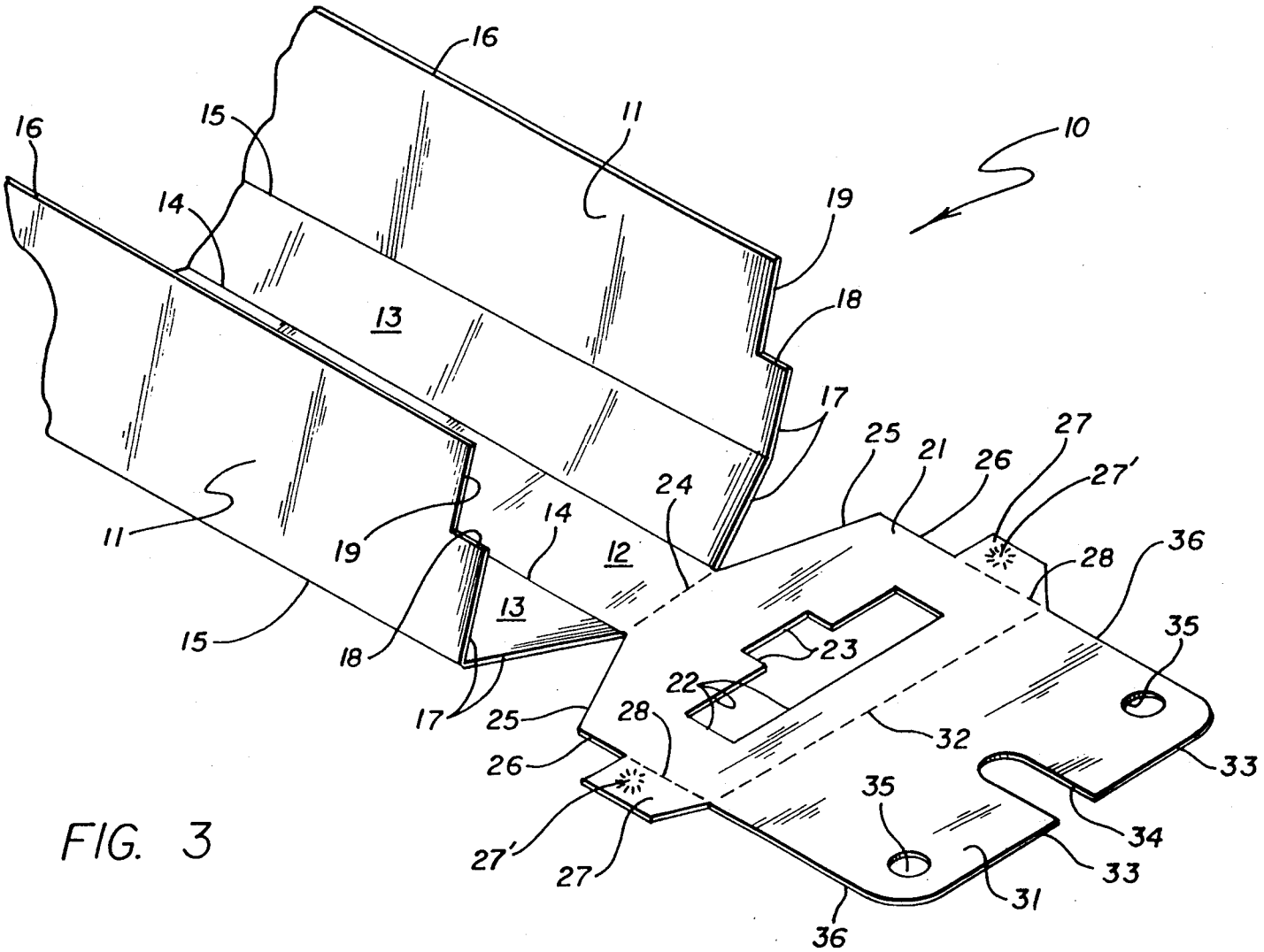
FIG. 3 is an isometric or perspective view of one end of a partly formed ballast can for use in either the FIG. 1 or FIG. 2 embodiment. The sheet-metal blank for the can is fully die-cut and punched, but only the sides are bent up—and they are resiliently biased laterally outward.

Optionally if desired such guidance could be enhanced by deforming the side tabs 27 inward in small dimples 27' (FIG. 3). We have found assembly quite satisfactory, however, without that additional feature.

As the bottom surfaces 54 of the ears 55 approach the horizontal cut bottom edges 18 of the notches 18/19, the forward tip of the outward-projecting circumferential flange 52 slips easily through the orifice 22 and protrudes very slightly as shown in FIG. 5. At this stage the positioning of the connector is very preliminary and rough, and only shown by FIG. 5 in a very representative way.

For example, in one extreme situation the ears may rest squarely in one or both notches, with the rearward edge 53 of an ear closely juxtaposed to the vertical edge 19 of the corresponding notch—as may appear from the portion of FIG. 5 that shows the near corner. Instead the ears may be slightly canted horizontally—as may appear from the portion of the illustration showing the far corner, where the vertical edge 19 of the far notch 18/19 is visible to the left of the far ear 55.

In either event the ears 55 and flange 62 remain somewhat spaced away from the inside surface of the end wall 21. The forward edge of the wall that defines the secondary cavity 57 also remains spaced somewhat inward from the end wall 21, behind the cut edges of the small recess portion 23 of the orifice 22/23. FIG. 5 shows all these relations clearly.

Alternatively, as another extreme case, it is particularly easy for the entire connector body to fall forward toward the end wall 21, so that the ears 55, flange 62, and secondary-cavity wall 57 rest lightly against the inside surface of that wall 21. Moreover the connector 50 can come to rest preliminarily in any of a great variety of positions intermediate between the two extreme orientations just described.

Successful practice of our invention does not depend upon orienting the connector 50 in any particular one of these conditions—provided only that (1) the ears 55 are somewhere in the notches 18/19 and between the side tabs 27, and (2) the entire periphery of the forward-projecting flange 52 is either started through the orifice 22 in the end wall 21, or sufficiently well aligned with the orifice 22 at the instant when the next stage of assembly begins to start through it readily.

This independence of any fine prealignment, or any other sort of fussing with the pieces, is a particularly valuable aspect of our invention. As previously pointed out, and as we shall shortly explain in terms of the very lenient tolerance requirements for the structures involved, this independence is not significantly traded off against fabrication costs but rather is a natural product of the unique geometry.

FIG. 6 represents the next assembly stage. Here pressure 101 is applied laterally inward, and pressure 102 is applied longitudinally inward, on the side and end walls 11, 21 respectively. This pressure 101, 102 is commonly provided by inserting the assembly bodily into a jig—sometimes denominated a "pouring fixture"—which returns the walls to their previously substantially upright or perpendicular positions as obtained during bending. For purposes of this document, elements of the pouring fixture can be regarded as represented by the arrows 101, 102.

In these position the gaps illustrated and previously discussed in connection with FIG. 4 are all substantially closed up. At the same time the connector 50 is progressively forced square, erect and flat against the end wall 21.

More specifically, the ears 55 are captured between a pair of opposing jaws—each formed by a notch vertical edge 19 at one side and the inside surface of the end wall 21 at the other. As these jaws come into near-parallelism, and approach a spacing that closely approximates the thickness of the ears 55, the jaws force the ears into line—straightening the ears in the notches—and the rest of the connector body follows suit.

While the lower structure 10 and the connector 50 are held firmly in this condition, potting material is poured as at 103 into the structure 10, and around the connector, wires and associated components 92–95. The coverplate 40 is then affixed as in FIG. 8, so that the long side tabs 47 retain the side walls 11 inward—and the fasteners 38 hold the end segments 31 and thereby the end walls 21 inward. The assembly 10/40/50 etc. can then be removed from the pouring fixture and set aside for cooling and solidifying of the potting material.

It can now be more fully appreciated why successful practice of the foregoing aspects of our invention is relatively independent of fine adjustments and fussy prealignment. For one thing, the forward-projecting flange 56 need not fit through the orifice 22/23 very closely: the seal between the connector 50 and the end wall 21 is formed by flat-abutting parts all around the orifice.

Further, the notches 18/19 may be slightly taller than the ears 55, provided that the fit is close enough to permit only very little leakage. This is not a severe constraint, for the notches are only a small fraction of an inch wide and any resulting gap is backed up at least esthetically by the side tabs 27.

The only fit between the connector and the can that is to any extent critical is the match between the widths of the notches 18/19 and of the ears 55. Here a relatively close tolerance is required, the ears preferably being if anything slightly narrower than the notches, as it is this fit that ensures a close abutment between the flat-abutting parts 55, 62, 57 and the end wall 21, as previously mentioned—to prevent leakage at the orifice 22/23.

This is true particularly around the small lower recess portion 23 of the orifice, where the path to potting material is relatively short. This sensitivity can be minimized if desired by provision of a small peripheral flange 68 (FIGS. 12 through 14, and FIG. 16) around the hook chamber 57, to lengthen the leakage path.

Similarly such a structure can be continued in a like flange 69 (FIGS. 12 through 14, and FIG. 16) along the bottom of the body 58, at both sides of the hook chamber 57. This latter flange 69 even further reduces leakage along the bottom edge of the large upper section 22 of the orifice 22/23.

We consider it within the scope of our invention to cut the notches 18/19 at positions, along the end edges 17 of the side walls 11, other than those illustrated and above discussed. In some ballast-can configurations, for example, the notches can be slightly lower—with an upper edge (not illustrated) of each notch formed just below the top edges 16 of the side walls.

In that arrangement, because of clearances arising from springiness of the various walls, the same general geometry and procedure can still be employed for insertion of the connector—adjacent to and protruding through the end wall.

Another alternative is to omit the metal end wall 21 entirely, and to form the connector so that it fills the space at the end of the longitudinal walls and floor 11–13. Now it can be appreciated that notches 18/19 cut into the end edges 17—about halfway, or even more, down those edges—locate the connector effectively relative to the panels 11–13.

This locating action is sufficient for positioning of the lower structure, half connector, and internal electrical components within a pouring fixture. Later, coverplate tabs or the like secure the side walls 11 inward to maintain the closure, as in the geometry illustrated and earlier discussed.

To reduce the number of segments along which the connector edges and metal panels have to match, in the configuration under discussion, the angled lower side panels 13 can be eliminated if desired—and the side walls 11 and the floor 12 instead can be run all the way outward and downward to join each other in bottom corners.

Figure 10:
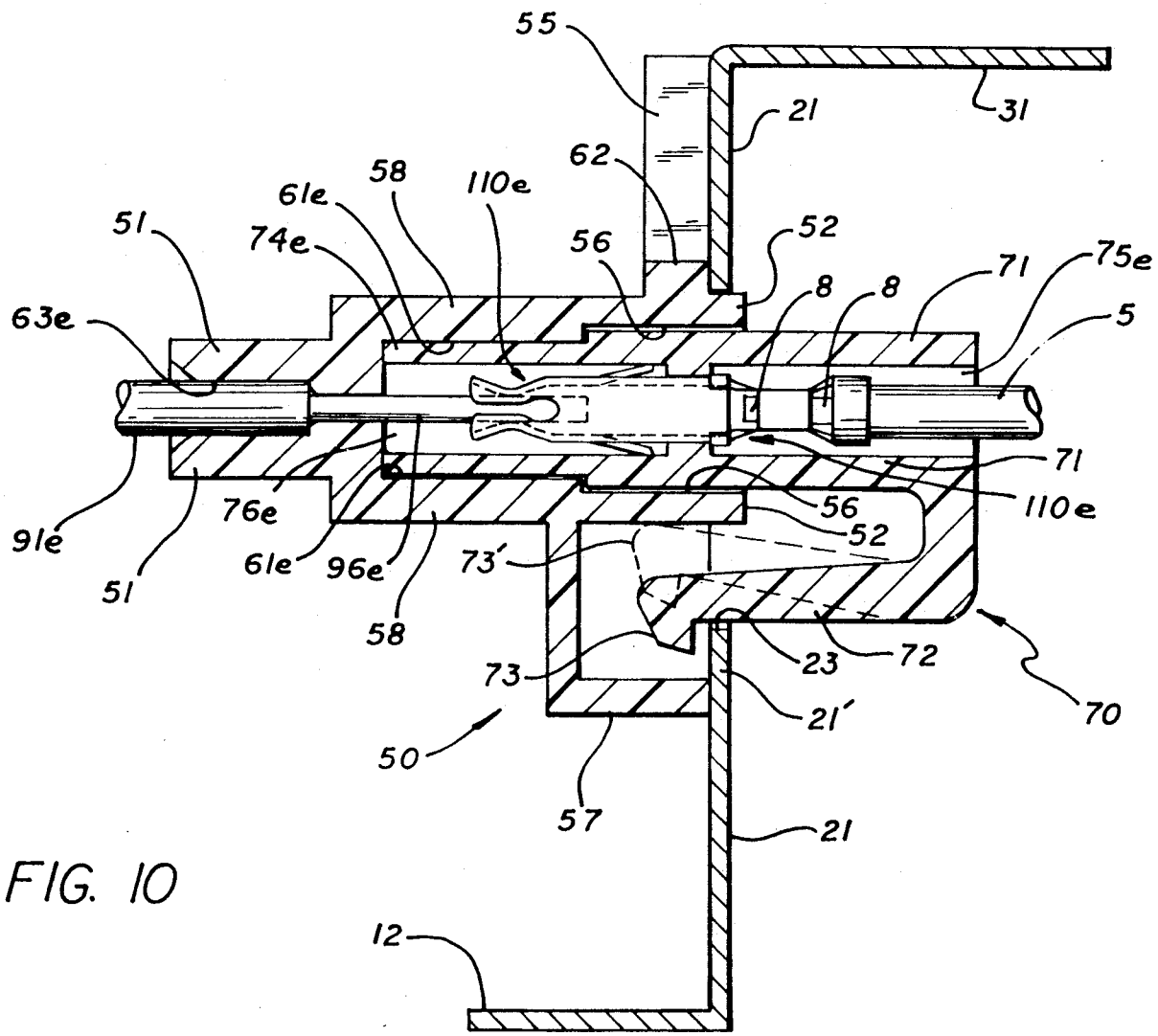
FIG. 10 is an elevation in longitudinal section, showing the internal and external half connectors mated, in one preferred embodiment of our invention.

FIGS. 10 and 11 show interfitting between the two half connectors 50, 70 and the end wall 21—for two alternative forms of the connectors, which correspond to use of female contacts in the external and internal half, respectively. These drawings also show how we prefer to provide male and female contacts for use in the connectors. Details of the connector and contact features appear in FIGS. 12 through 29.

As shown in FIGS. 10 and 11, a standard internal lead of a ballast—or a standard fluorescent-fixture wire—can serve as a male pin for one or the other half of the connector. In FIG. 10, an internal lead 91*e* is stripped to provide a bared end 96*e* that is used as a male pin; and a female contact 110*e*, crimped to the bared end 8 of an external harness wire 5, receives that male pin 96*e* when the connector halves mate.

In FIG. 11 it is the external harness wire 5 that is stripped, providing a bared end 8 that serves as a male pin; and it is the internal lead 91*e* whose bared end 96*e* is crimped in a female contact 110*e*. The female contact is substantially greater in diameter than the male pin; therefore whichever half connector carries the female contact has a contact chamber that is of relatively large diameter necessarily.

If the mating half connector were designed to fit within the female-contact-carrying half, surrounding the female contact, then the female-contact-carrying half would require a contact chamber of even greater diameter. Use of such a large, open chamber would increase the likelihood of inadvertent damage to the female contact.

Accordingly we prefer to make whichever half connector carries the female contacts 110*e*, etc., serve as the male half of the connector—i.e., a jack 71 or 61*e*′ etc. That male half connector is then inserted into the other half connector 58′ or 71′, which carries the male pin 96*e* or 8, etc.; that other half is therefore configured as the female half of the connector—that is, a receptacle.

As FIG. 11 shows however, a simple construction in which the internal half connector is a jack 61*e'* results in substantial protrusion of that half connector from the end wall 21. If this protrusion is considered undesirable in terms of risk of damage to the jack 61*e'*, etc., the jack may be—at somewhat greater cost—recessed within the end wall 21.

To explicitly represent the above-discussed ballast-can geometry (FIGS. 1 through 9) with use of the FIG. 11 embodiment, or with that embodiment modified by recessing as described in the preceding paragraph, certain revisions would be required in the details of FIGS. 1 through 6, and FIGS. 8 and 9. The connector flange 52 shown in those drawings would have to be redrawn—either protruding further as a group of elongated contact chambers 61, each like the chamber 61*e'* in FIG. 11; or having such a group of chambers 61 recessed as just described.

Rather than substantially duplicating several of those drawings, we hereby incorporate by reference the features of the FIG. 11 embodiment, as alternative forms, into those other drawings of this document that show connector features. Hence those other drawings are to be considered as representing all three connector geometries—i.e., those of FIG. 10, FIG. 11, and the described modification of FIG. 11.

In both FIGS. 10 and 11 the lower part of the end wall 21 forms a lip 21', which constitutes the edge of the lower recess portion 23 of the orifice 22/23. The lip 21' extends slightly above the bottom of the hook-receiving chamber 57 formed in the internal half connector.

For passage of the hook tip 73 into the chamber 57, the hook 72 can be deflected so that its tip 73 moves to a raised position 73' as represented in the phantom line in FIG. 10. A user can accomplish this deflection by squeezing the shank 72 of the hook upward toward the external half connectors 71.

Alternatively, a user can simply push that half connector into place in the internal half. During this process the angled forward surface 73' (FIG. 19) of the tip 73 operates as an inclined plane against the lip 21', forcing the hook 72/73 upward in the manner of a ratchet.

In either event, once the tip 73 has passed the lip 21' the hook 72 can be allowed to spring back downward so that the lip 21' captures the hook tip 73. The hook 72 and thereby the external half connector 70 are thereby retained in place until a user again operates the hook tip 73 to its upper position 73'—this time necessarily by squeezing the shank upward—for removal.

FIGS. 10 and 11 are taken along the longitudinal centerline of the assembly. Therefore the lead, wire and contact—and the connector chambers in which they are held—shown in FIGS. 10 and 11 represent the central wiring positions, of the several positions preferably provided in connectors according to our invention.

As shown in FIGS. 12 through 16, an internal half connector (receptacle) 50 forming part of a preferred embodiment of our invention is segmented into nine contact-mating chambers 61 in a row 61*a* through 61*i*. These chambers 61 (or 61*a* through 61*i*) are cylindrical, and are recessed within the previously mentioned antechamber 56.

FIGS. 17 through 21 show that our preferred external half connector (jack) 70 is similarly segmented to form nine contact chambers 74 (or 74*a* through 74*i*). When the jack 70 and receptacle 50 are connected together, these contact chambers 74 of the jack 70 are first received in the antechamber 56 of the receptacle 50.

The antechamber 56 serves to prealign the jack contact chambers 74 and guide them into the contact-mating chambers 61. This guiding function is enhanced by fitting of rails 88, along the outboard sides of the jack 70, into mating grooves 61' at both sides of the antechamber 56 (and then continuing into the two outboard contact-mating chambers 61*a*, 61*i*).

Leads 91 (or 91*a*, 91*b*, and 91*d* through 91*i*, FIG. 10) from the electrical components of the ballast are introduced into the receptacle 50 from the opposite or rear end, through insulated-lead holding chambers 63. The leads 91 are secured within the holding chambers 63 by the strain-relief provisions of our invention—discussed elsewhere in this document—or if preferred by conventional plastic-welding techniques, or other means.

The stripped ends 96 of the leads 91 are further inserted into bared-lead guide channels 64. From these channels 64 the stripped ends 96 of the leads 91 extend forward into the contact-mating chambers 61. There each stripped lead end 96, serving as a male contact or pin, engages a female contact 110—as shown in FIG. 10 for the central chamber 61*e*.

Figure 13:
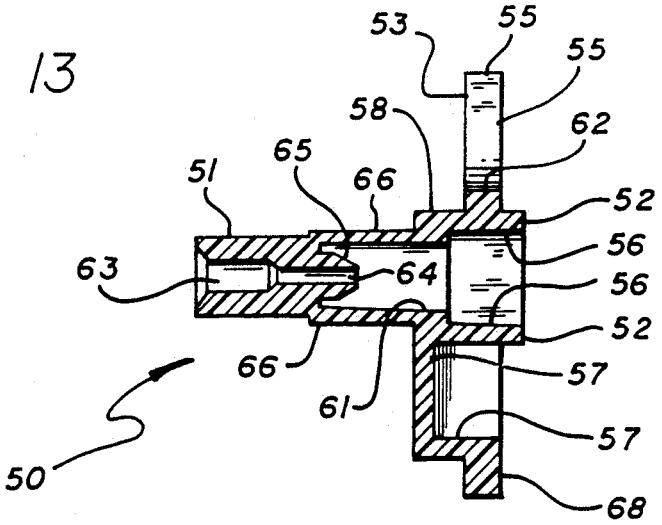
FIG. 13 is a side elevation of the same receptacle.
Figure 15:
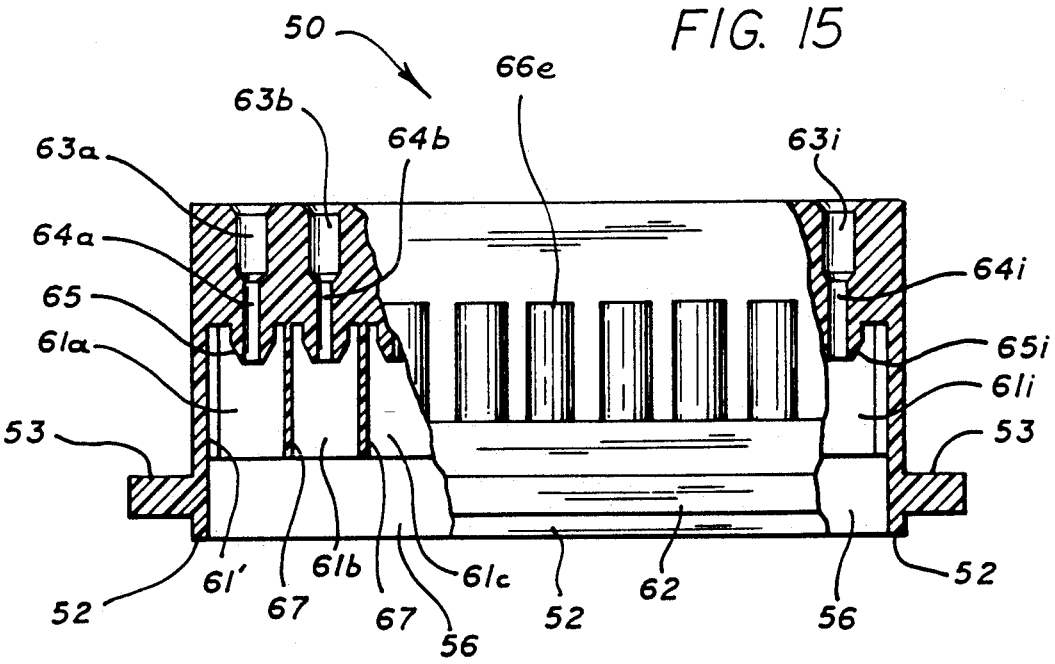
FIG. 15 is a top plan, partly in longitudinal section, of the same receptacle.
Figure 21:
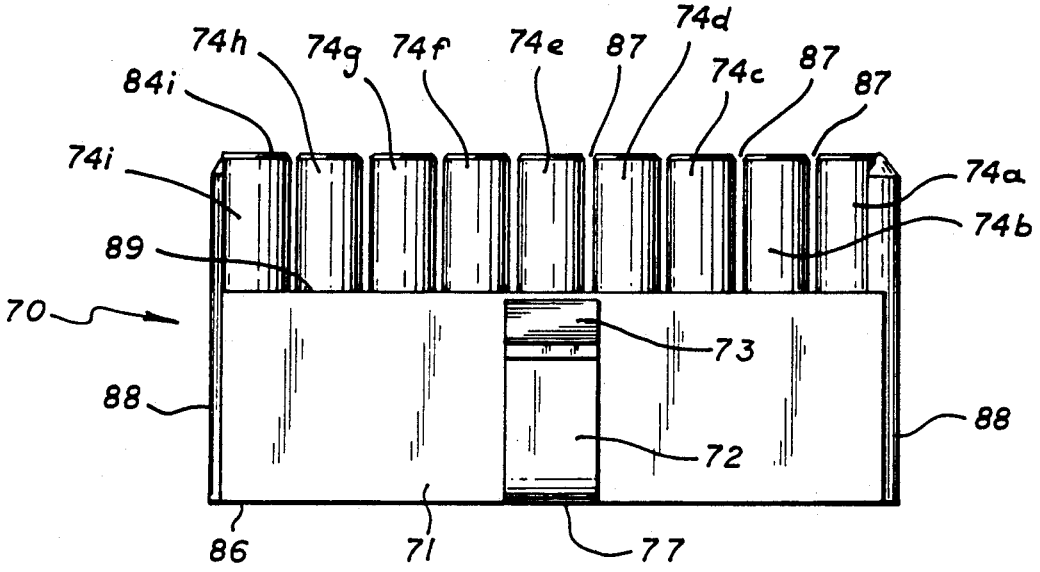
FIG. 21 is a bottom plan of the same jack.

For best pin alignment we extend the bared-lead guide channels 64 as far forward as possible. To accomplish this we form a central bulge in the rear wall 65 (or 65*a* through 65*i*) of each contact-mating chamber 61, as seen in FIGS. 13 and 15.

Each bulge 65 is separated from the cylindrical surface of its chamber 61 by a thin annular space. This space receives the annular tip 84 (FIG. 17, and FIGS. 19 through 21) of the corresponding contact chamber 74 of the jack 70.

The centerlines of the nine wiring positions 61-64-63 in the receptacle 50 are spaced apart from one another by just enough to preserve thin walls 67 (FIGS. 12 and 15) between the cylindrical interior surfaces 61 of the contact-mating chambers. These walls are desirable to maximize pin-to-pin distance through air, for voltage-standoff purposes.

To minimize material usage, we prefer to make the receptacle body 51 as shallow as practical. A countervailing consideration is maintenance of adequate wall thickness all the way around the contact-mating chambers 61.

Figure 14:
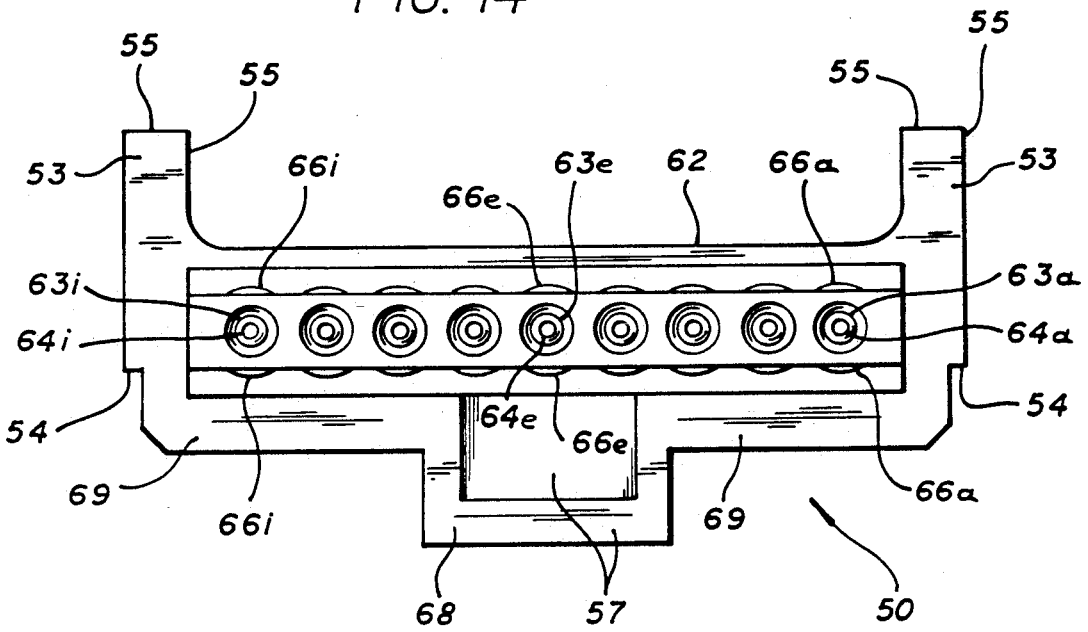
FIG. 14 is an inside end elevation of that receptacle.

We prefer to address both these goals by forming nine very shallow vertical enlargement 66 of the body 51, only where needed just above and below the central regions of the contact-mating chambers 61. As shown in FIGS. 14 through 16, each enlargement 66 (or 66*a* through 66*i*) may take the form of a cylindrical segment.

As seen in FIGS. 17 through 21, the wiring positions of the jack 70 are configured quite differently from those of the receptacle 50. As already noted, the forward end of the jack 70 is segmented to form nine discrete cylindrical contact chambers 74; these are separated by thin spaces 87 that accommodate the thin walls 77 in the receptacle 50.

The cavities 75–76 in the jack 70 also are shaped quite differently from those of the receptacle 50. Except for the molding draft (shown exaggerated in FIG. 19), and an internal shoulder or contact anchor 81 about midway through, each cavity 75–76 of the jack is nearly uniform in diameter.

Each cavity 75–76 also is large enough to receive a female contact 110 (FIGS. 10, 11 and 23 through 29). In assembly, the contact is first precrimped onto an external wire 5 (or any of the wires 3, 5, 6, 7, 3' or 5' of FIGS. 1 and 2) and onto its insulation 8; and is then inserted from the rear end 86 of the jack 70 into the rear chamber 75 of the cavity 75–76.

The contact 8 is advanced through the rear chamber 75 and partway through annular internal shoulder 81. This motion continues until two forward stop-tangs 117 (FIGS. 23 through 27) formed in the contact 110 have passed entirely through the shoulder 81, and a rear stop 122/123 formed on the contact has engaged a rear stop surface 82 of the internal shoulder 81.

Figure 23:
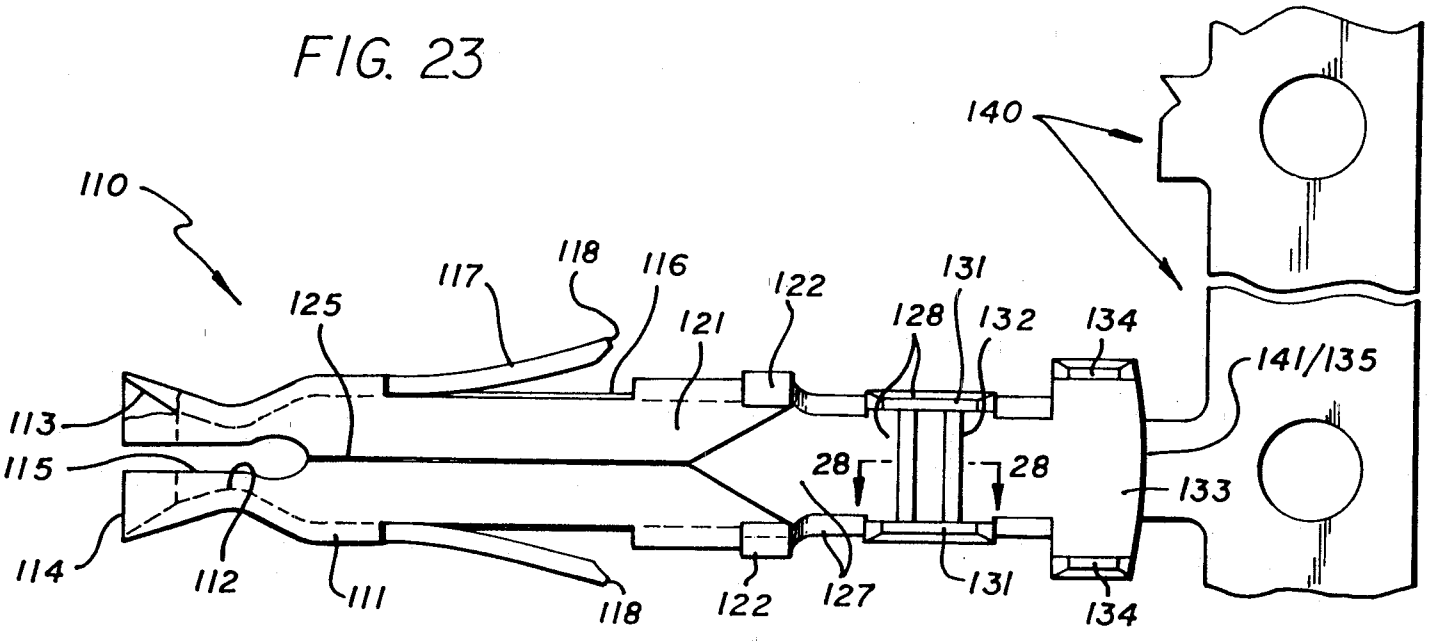
FIG. 23 is a top plan view, greatly enlarged, of a female contact in a preferred embodiment of our invention.
Figure 24:
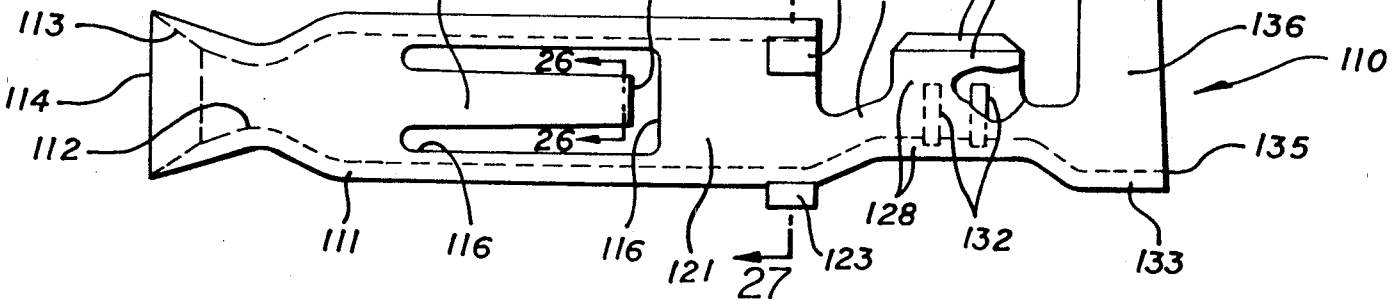
FIG. 24 is a side elevation of the same contact.

The tangs 117 are biased outward from the contact body 121, as shown in FIG. 23. As they begin to pass through the shoulder 81, that shoulder bends the tangs temporarily inward against their internal bias and toward the contact body 121.

When the rear end 118 of the tangs pass through the shoulder 81, the tangs 117 spring back outward, positioning the tang rear ends 118 just forward of a front stop surface 83 of the shoulder 81. The annular internal shoulder 81 is then captured between the rear stop 122/123 and the tang ends 118 of the contact 110—or, to put it another way, the contact is anchored to the internal shoulder or "contact anchor" 81.

As will be seen, the contact can be secured within the jack 71 by strain-relief features of our invention instead, or other methods if preferred. In either event, the female contact or socket 110 and its attached wire are firmly secured in the jack 70, and carried by the jack into engagement with a male pin in the receptacle 50, as previously described.

The connector of FIGS. 12 through 21 is very readily adapted to ballast cans of a great variety of different shapes and larger dimensions, merely by making the ears laterally longer. This is shown in FIG. 22, where an extension segment 155 is formed so that the tips of the ears 55' are further outboard.

Figure 22:
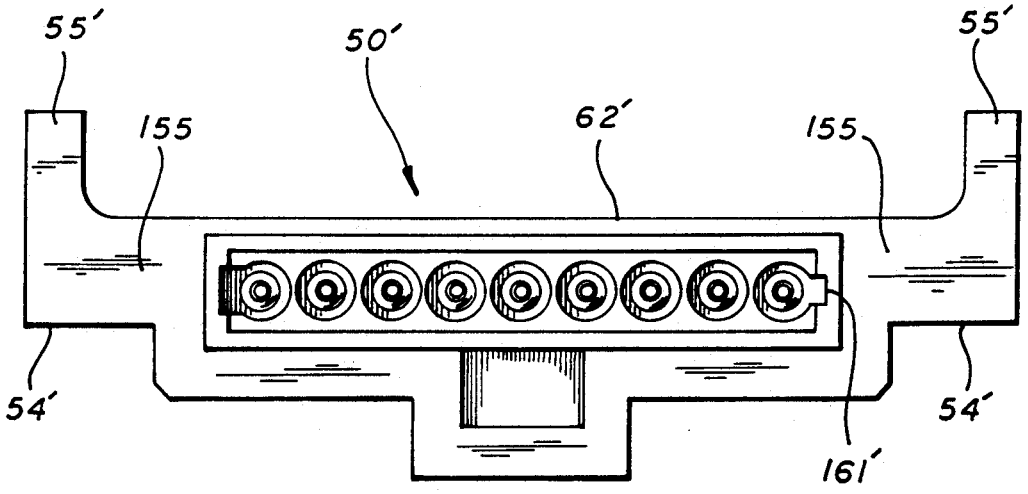
FIG. 22 is an outside end elevation, similar to FIG. 12, of the receptacle in another preferred embodiment of our invention, similar to that of FIG. 10 and FIGS. 12 through 16.

In the configuration of FIG. 22, the engagement of the ears 55' (and the connector 50' generally) with the ballast notches 18/19 and end wall 21 is substantially as described earlier for the previously discussed receptacle 50 of FIGS. 5, 6, and 8 through 16. Precisely the same jack 70 can be used with both receptacles 50' and 50.

The contact 110 shown in FIGS. 23 through 29 is suited particularly for making and maintaining (in event of any vibration at the connections) a good wiping contact with the bared-lead (or bared-wire) male pins, without damage to the pins. It is similarly well-suited for repetitive connection and disconnection without damage.

These benefits arise from provision of a circumferential, generally cylindrical contact body 111, 121 that generally encircles the pin and makes a very smooth engagement at a smoothly shaped constriction 112. Upon insertion—and thereafter in event of vibration—the constriction 112 effects a nondestructive cleaning action and a resulting excellent electrical connection.

Each contact 110 is formed as one of a multiplicity of substantially identical units, initially held together in a row as by a common fabrication strip 140 (FIG. 23). Each contact 110 is removed from the fabrication strip 140 by breaking away along the score 141/135, after which the edge 135 (FIGS. 24 and 25) constitutes the rear end of the contact.

After die-cutting, opposite sides of the blank for each contact are curled around to a top seam 125, and a segment 113 that is forward from the constriction 112 is flared outward to a bell 113. The tip 114 of the bell 113 is circular, except where interrupted at top and bottom by formed cross-slots 115.

Figure 26:
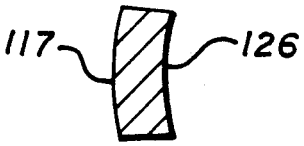
FIG. 26 is a cross-sectional elevation, taken along the line 26—26 in FIG. 24 and even further enlarged, of a portion of the same contact.
Figure 27:
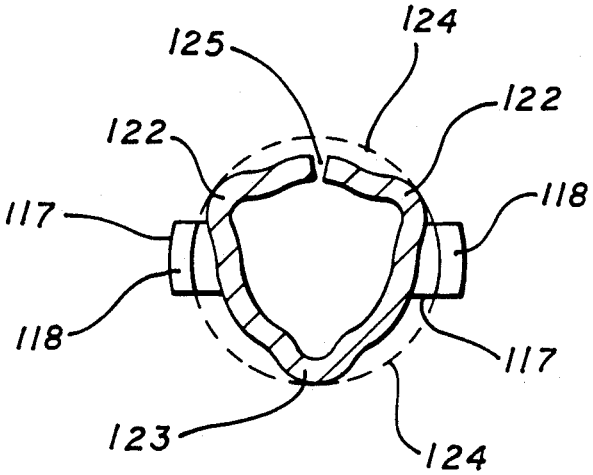
FIG. 27 is a cross-sectional elevation, taken along the line 27—27 in FIG. 24, of the same contact.
Figure 28:
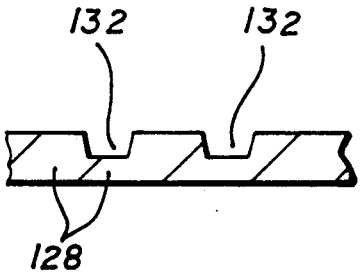
FIG. 28 is a side elevation, in longitudinal section along the line 28—28 in FIG. 23 and further enlarged with respect to FIGS. 23 and 24, of a portion of the same contact.

The cross-slots 115 enhance resiliency of the structure, and so enhance the wiping-contact action of the constriction 112. Initial die-cutting forms a "U"-shaped cutout 116 in each side wall, and thereby defines the previously mentioned tangs 117—which are slightly curled as shown in FIG. 26.

Rearward from the cutout 116 and tangs 117 is a transitional segment 121 of the contact 110, followed by a rearward portion that is distorted to form three radial lobes 122, 123 (FIGS. 23 through 27). These two upper side lobes 122 and single bottom central lobe 123 cooperate to serve as the rear stop 122/123 mentioned earlier. The generally cylindrical forward segments 111, 121 appear in the phantom line in FIG. 27.

Rearward of the stop 122/123 is another transitional segment 127, which angles upward toward the rear to elevate the next segment 128 closer to the centerline of the structure. That next segment 128 is configured for crimping tightly around the bare conductor, and accordingly the floor of this conductor-crimping segment 128 is elevated into alignment generally with the bottom of the frontal constriction 112.

To enhance the longitudinal traction or grip of the conductor-crimp segment 128 against a bare wire, we prefer to preform serrations 132 (FIGS. 23, 24 and 28) around most of the interior surface of the crimp segment 128. Wrapping tabs 131 are formed to extend upward at both sides of the conductor-crimping segment.

Figure 25:
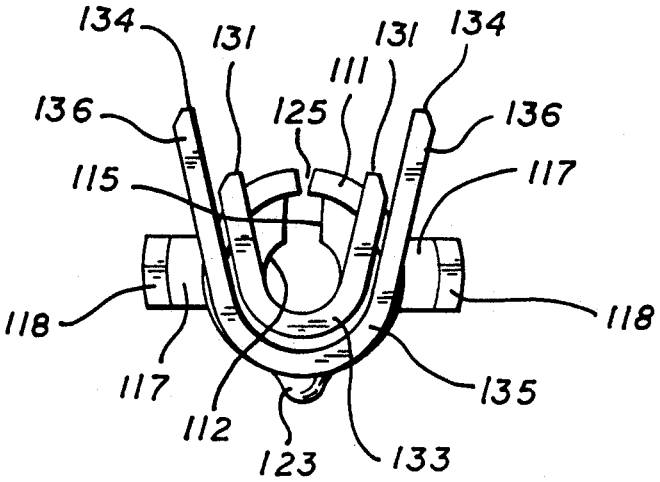
FIG. 25 is a rear end elevation of the same contact.
Figure 29:
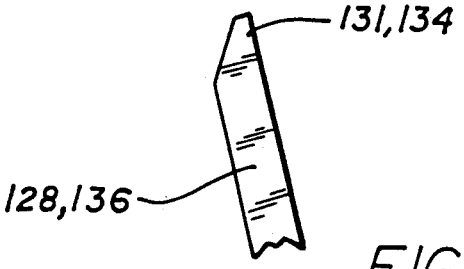
FIG. 29 is an end elevation, very greatly enlarged and showing details of a coined insulation-gripping or conductor-gripping tab, in the same contact.

Behind another transitional segment (this one angled downward toward the rear) is an insulation-crimping segment 133, with longer wrapping tabs 136 to extend around the insulation of the wire. As FIGS. 25 and 29 show, the tips 134 of these tabs 136, and the tips 131 of the conductor-crimping segment as well, are all coined.

Figure 31:
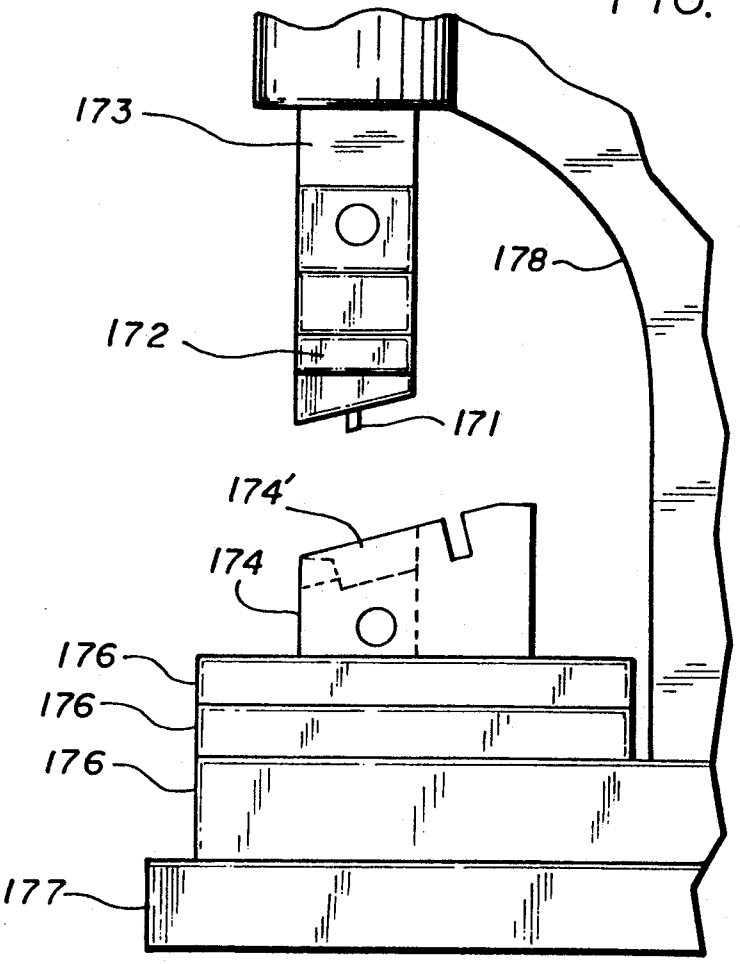
FIGS. 30 and 31 are somewhat schematic front and side elevations of multiple-punch tooling for displacing material of a multiple-lead connector, to provide strain relief in accordance with a preferred embodiment of our invention. A representative connector body is also shown.
Figure 30:
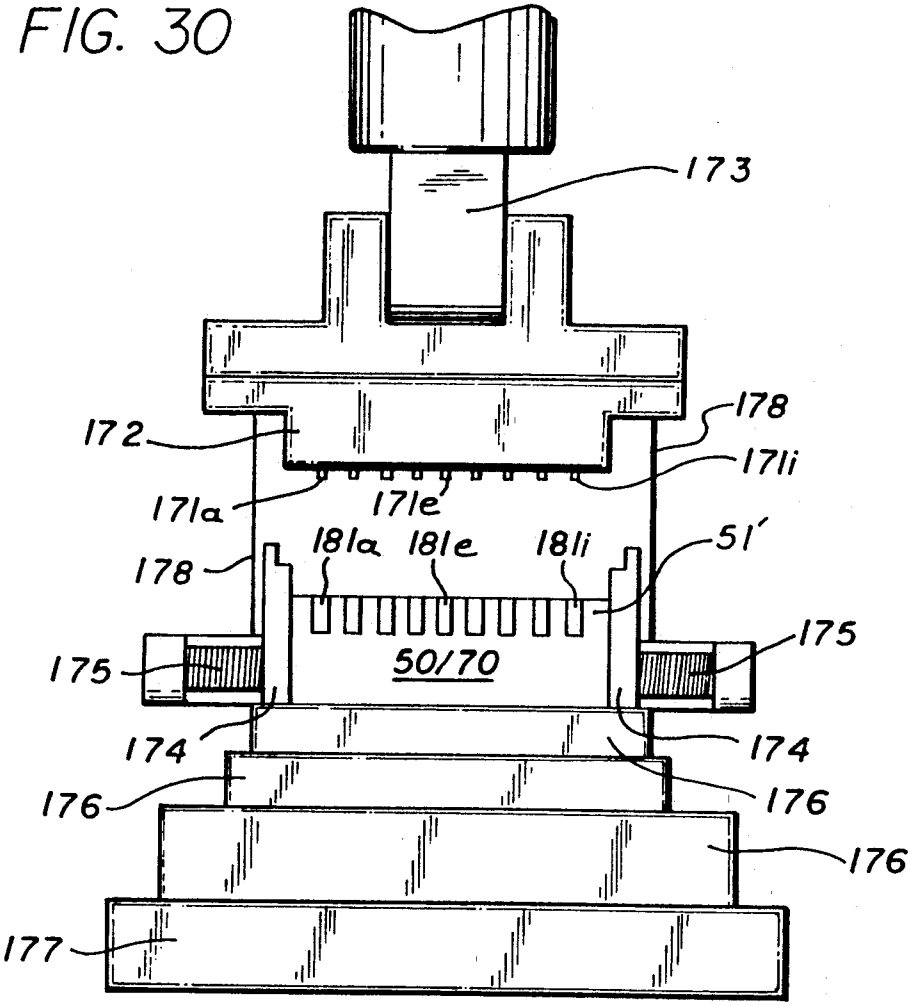

It remains to describe the strain-relief features of our invention. The apparatus of FIGS. 30 and 31 provides strain relief simultaneously for all the wiring positions (not shown) of a receptacle or jack 50/70.

Multiple punches **171*a* through 171*i* are mounted in a unitary chuck 172 that is driven downward vertically by a ram 173, held on a support 178. The workpiece, namely a half connector 50/70, is held by lateral spring-loading 175 in a jig 174 that includes a cradle 174'**, preferably inclined at a small angle—less than thirty degrees and preferably about fifteen degrees.

If the cradle 174' is not angled, preferably the punches **171*a* through 171*i*** are angled instead. In either case, their path through the connector body is off the perpendicular to the axis of the wire-holding chambers, by a small angle as noted above. It will be shown that such a relative angle enhances performance of our invention, but also that the invention can be practiced with the punches substantially at the perpendicular if preferred.

Suitable pedestals and base 176 are included. These allow the entire apparatus and workpiece to rest on an ordinary workbench or like station 177.

FIG. 32 offers a more-detailed but schematic view of a receptacle or jack 50/70, together with just one 171 of the relatively angled punches **171*a* through 171*i* ready for operation. The half connector 50/70 may be regarded as one outboard side of the receptacle 50** described earlier.

An insulated lead 91 is shown extending into an insulated-lead holding chamber 63 in one wiring position of the receptacle 50. The body 51 of the receptacle is drawn broken away at 182, to show the bared conductor 96 extending onward within the body 51.

The position 183 to be punched, in FIGS. 32 through 34, is substantially featureless. That is, the half-connector wall in that region is neither preperforated nor otherwise distorted or marked. It is also not prestressed.

Thus in simplest theory no special preparation, external or internal, is required for practice of this aspect of the invention. The angled punch 171 is simply advanced, generally parallel to its axis, into the surface region 183 above the wire insulation 91.

FIG. 33 shows that the punch preferably is formed with a tip that is angled slightly downward from the horizontal, allowing for the orientation of the punch shank 171. This tip first snaps away the material 183 at the forward edge of the impact area, and begins to bend the rearward edge—thereby starting to form a slug 183 of material.

With continued advance of the punch 171 parallel to its axis, the rearward edge of the impact area also breaks away. The slug 183 is next bodily displaced into the chamber 63—and then further displaced into compressive wedged engagement with the insulation 91—leaving an aperture 184.

The punch 171 is then withdrawn, leaving the assembly as FIG. 34 shows (with some exaggeration of the distortion 185 of the insulation 91). When a sharp tool 171 is used and the thickness of wall 51 is in a suitable range, the slug 183 snaps out cleanly enough that the wall retains much of its structural integrity.

The slug 183, once pushed past the bottom edge of the now-perforated ceiling of the chamber 63, is cocked relative to the aperture 184—that is to say, no longer oriented for sliding motion in the aperture. No source of reorienting force is available, so the slug 183 remains cocked, and remains wedged between the inner cylindrical surface 63 and the insulation 91, at the aperture 184.

Now light withdrawal force 186, up to twenty pounds or even somewhat more, may be applied to the insulated wire 91, in the form of tension on the wire outside the connector body 51. The wire responds by moving outward, carrying the slug 183 with it, but only far enough to jam the rear corner of the slug against the rearward edge of the aperture 183.

The cocked slug 183 cannot escape either through the aperture 184 or—because the slug is jammed against the rearward edge of the aperture 184—longitudinally through the cylindrical chamber 63. Because the insulation 91 is also jammed against the slug 183, the slug locks the insulation in place and the wire cannot be withdrawn.

Figure 35:
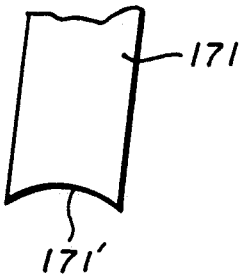
FIG. 35 is a side elevation showing one preferred embodiment of the tool of FIGS. 32 through 34.

As FIG. 35 shows, the end of the punch 171 can be made concave, yielding a double-cusped tip 171' to most effectively start breaking away the forward edge of the half-connector wall as a neatly formed slug. We have found, however, that this relatively elaborate tooling shape is not required.

As already stated, no surface preparation or internal preparation is required in principle for our slug-lock strain relief. We have found, however, that one minor departure from this principle may be helpful.

The half-connector general wall thickness is selected to optimize the structure as between structural strength and material cost. As may be expected, a different wall thickness is optimum for neatly snapping breakaway slugs into the insulated-wire chambers while otherwise maintaining the integrity of the walls.

Figure 36:
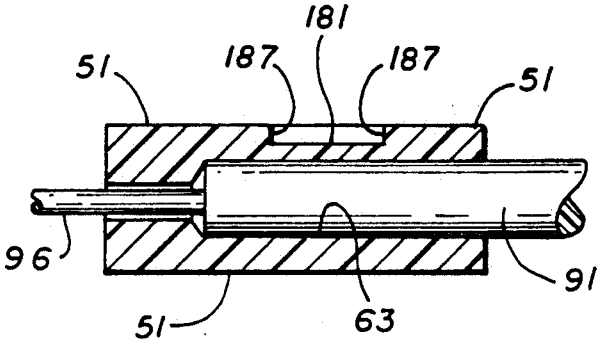
FIG. 36 is a view similar to FIG. 33 for the same tool and for a similar connector that is another preferred embodiment—but drawn without the tool, and showing a preformed inset or recess at the site where material is to be displaced.

We have found that the slug-lock-optimizing thickness is smaller than the general-structure-optimizing thickness. For that reason we consider it advantageous to preform shallow recesses 181 (FIGS. 31 and 36) into the half-connector wall 51 at the points where the punches 171 will act. Each recess 181 may be formed with vertical walls 187, if desired.

Figure 37:
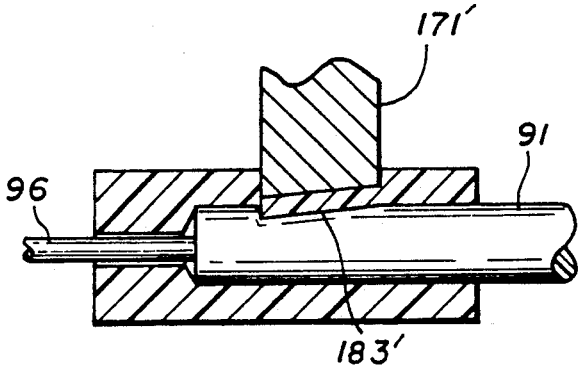
FIG. 37 is a view similar to FIG. 33, but for one form of the FIG. 36 embodiment.
Figure 38:
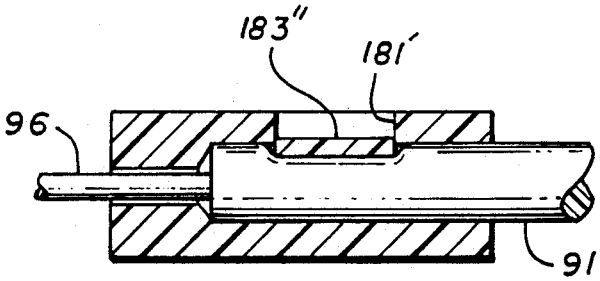
FIG. 38 is a view similar to FIG. 34, but for another form of the FIG. 36 embodiment.

If provided with an angled tip, even a vertical punch 171' (FIG. 37) can create an angled slug 183' that deforms the insulation 91 and locks the insulation against the rearward corner of the aperture. Even a vertical punch with a right-angle tip can inset a slug 183" (FIG. 38) that deforms the insulation 91 enough to lock the wire against withdrawal.

Figure 39:
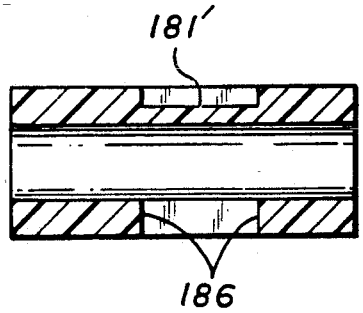
FIG. 39 is a view similar to FIG. 36, but for yet another preferred embodiment.

Yet another form of connector-body preparation appears in FIG. 39. Here a hole 186 is formed in the holding-chamber floor, directly opposite (below) the preformed recess 181' in the ceiling.

The slug is then pushed downward somewhat more forcibly, squeezing the insulation at the bottom of the chamber downward and outward into the hole 186. Slight deformation is also thereby produced in the segment of the conductor, within the insulation, that is between the preformed hole 186 below and the punched aperture above.

With sufficient force from the punch, the conductor deviates significantly out of line. Its deformation notably increases the combined resistance of the wire and insulation to withdrawal force.

Our slug-lock principle is not limited to displacing a single slug of material over the center of a lead. Among many variations is that shown in FIGS. 40 and 41—where the insulation 91 is pinched slightly between two off-center slugs.

Figure 41:
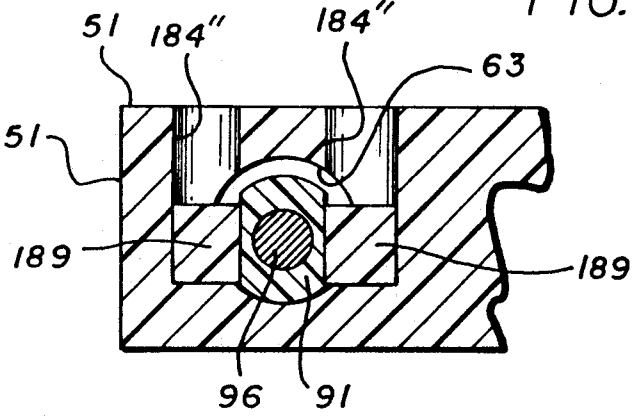
FIG. 41 is a cross-sectional elevation of the FIG. 40 embodiment after material displacement.
Figure 40:
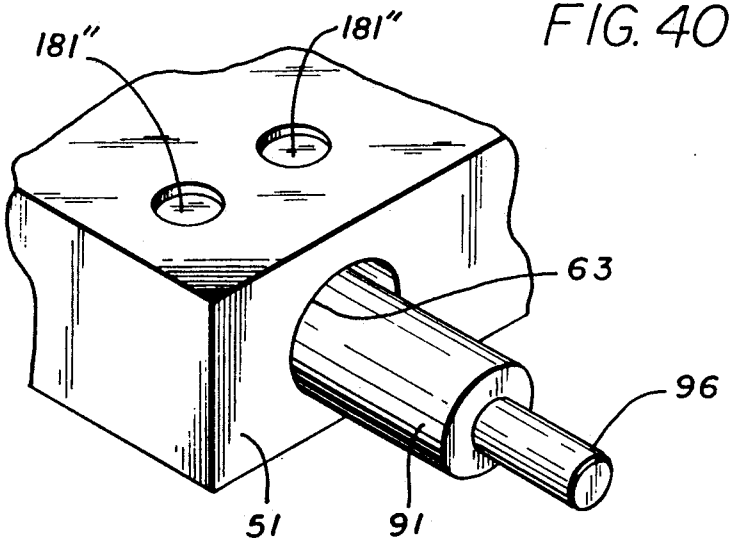
FIG. 40 is a fragmentary perspective or isometric view, similar to FIG. 32, showing a representative connector and one lead, before material displacement, in another preferred embodiment of the strain-relief aspects of our invention.

FIG. 40 shows that the punch location 181" (recessed as shown, if desired) are off to both sides of the insulated-wire chamber 63. FIG. 41 shows that the twin slugs 189 are driven vertically, along roughly punched-out channels 184", into positions that are partially within the chamber 63 and partially outside it laterally.

FIG. 41 probably exaggerates considerably the regularity of the slugs 189, particularly at their sides that are remote from the wire 91/96: in the embodiment illustrated, those remote portions are formed largely by crushing of material originally adjacent to the chamber 63.

Figure 42:
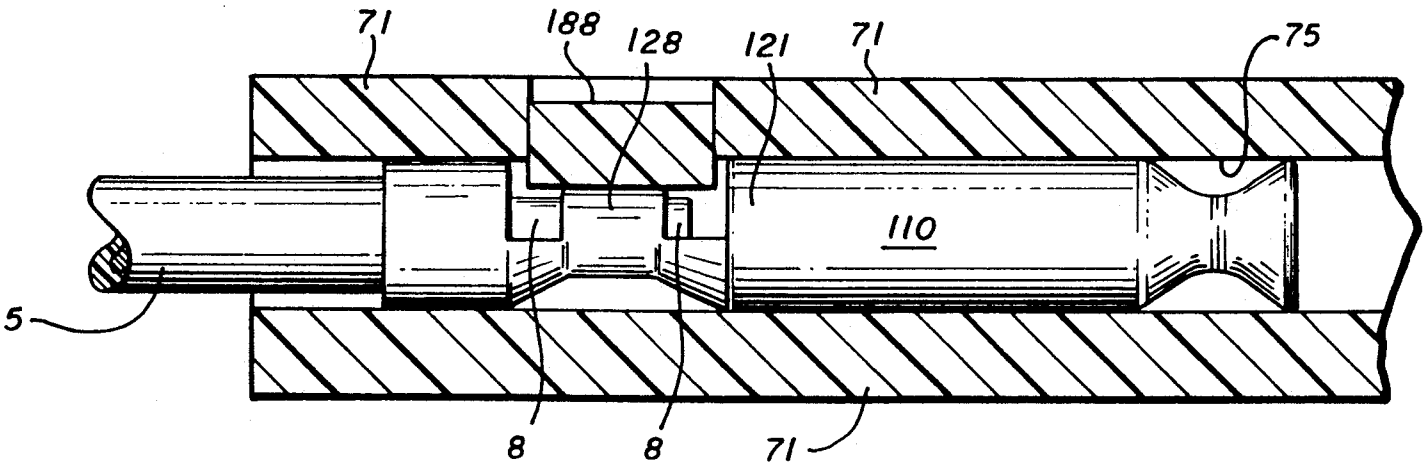
FIG. 42 is a side elevation, in longitudinal section, showing still another usage of our slug lock. Unlike FIGS. 32 through 41.

FIG. 42 shows a different use of the slug lock, namely strain relief for a female contact 110 of the type previously described and discussed. Instead of engaging a conductor 8 or its insulation 5 as in previous illustrations, a slug 188 here moves into the space available above the conductor-crimping segment 128 of the contact 110.

Upon application of withdrawal force, the intermediate section 121 of the contact promptly strikes the forward inside corner of the slug 188. This interference deters further withdrawal of the contact 110 and therefore of its attached insulated wire or lead 8, 5.

As previously stated, one particularly beneficial characteristic of our invention is that its successful practice is relatively insensitive to precison of tolerances. To facilitate practice of the invention by those skilled in our field, however, we tabulate below representative dimensions and angles for one preferred embodiment.

| | mm | inch |
|---|---|---|
| notches 18/19 | | |
| height 19 | 16.5 | 0.65 |
| width 18 | 2.7 | 0.11 |
| end wall 21 | | |
| width across folds 28 (inside the tabs 27) | 58.1 | 2.29 |
| aperture upper section 22 | | |
| height | 9.7 | 0.38 |
| width | 50.3 | 1.98 |
| aperture lower section 23 | | |
| height | 3.3 | 0.13 |
| width | 7.5 | 0.30 |
| receptacle 50 | | |
| overall width (across the ears 55) | 58.2 | 2.29 |
| ear height 53 | 16.5 | 0.65 |
| ear thickness 54 | 2.5 | 0.10 |
| flange 52 | | |
| outside width (outside the side guides 61') | 50.0 | 1.95 |
| inside width (ditto) | 47.2 | 1.86 |
| outside height | 8.9 | 0.35 |
| inside height | 6.1 | 0.24 |
| flange 52 depth (forward from hook cavity 57) | 1.5 | 0.06 |
| antechamber 52 depth | 5.3 | 0.21 |
| contact-mating chambers 61 | | |
| diameter | 4.6 | 0.18 |
| full depth | 8.9 | 0.35 |
| depth of rear-wall bulge 65 | 2.5 | 0.10 |
| width of flat annular seat surrounding bulge 65 | 0.76 | 0.030 |
| partitions 67 minimum width | 0.38 | 0.015 |
| bared-lead guide channels 64 | | |
| diameter | 1.07 | 0.042 |
| length (with rear c' sink) | 3.3 | 0.13 |
| insulated-lead holding chambers 63 | | |
| diameter | 2.16 | 0.085 |
| length (with rear c' sink) | 5.1 | 0.20 |
| jack 70 | | |
| overall width (across the side rails 88) | 46.7 | 1.84 |
| forward contact chambers 76/85 | | |
| outside diameter (taper) | 4.45–4.57 | 0.175–0.180 |
| outside depth to stop surface 89 | 9.1 | 0.36 |
| width of space separating adjacent chambers | 5.59–6.35 | 0.220–0.250 |
| inside diameter (taper) | 3.35–3.45 | 0.132–0.136 |
| inside depth to contact anchor 81 | 11.4 | 0.45 |
| annular radius at tip | 0.064 | 0.0025 |
| rearward contact chambers 75 | | |
| inside diameter (taper) | 3.35–3.45 | 0.132–0.136 |
| depth to contact anchor 81 (with inside bevel and rear c' sink) | 10.2 | 0.40 |
| hook 72/77 | | |
| height of heel 77 | 5.1 | 0.20 |
| length of shank 72 (from rear surface 86 to capture surface 78) | 10.7 | 0.42 |
| radius of extreme tip 206 | 0.3 | 0.01 |
| angle of shank 72 to contact-chamber centerline (with hook relaxed) | 3 degrees | |
| angle of hook capture surface 78 to shank 72 | 85 degrees | |
| angle of camming surface 73' to shank 72 | 40 degrees | |
| length of flat 204 between capture surface 78 and camming surface 73' | 0.8 | 0.03 |
| radius of transition 205 between flat 204 and capture surface 78 | 0.5 | 0.02 |
| anchor 81 inside diameter | 2.69 | 0.106 |
| anchor 81 length (excluding rear bevel 82) | 1.5 | 0.06 |
| anchor 81 rear bevel 82 | | |

-continued

| | mm | inch |
|---|---|---|
| longitudinal length | 0.5 | 0.020 |
| annular radial step | 0.28 | 0.011 |
| radius of transition 201 from bevel 82 to inside diameter of anchor 81 | 0.5 | 0.02 |
| anchor 81 forward stop 83 | | |
| annular radial step | 0.28 | 0.011 |
| angle of annular stop surface to diameter | 5 degrees | |
| contact 110 | | |
| overall length | 15.7 | 0.62 |
| material initial thickness | 0.30 | 0.012 |
| longitudinal inset from bell tip 114 to: | | |
| constriction 112 | 1.8 | 0.07 |
| "U" cutout 116 | 4.1 | 0.16 |
| tip 118 of tang 117 | 7.4 | 0.29 |
| stop surface 122/123 | 9.4 | 0.37 |
| forward edge of conductor crimping tabs 128/131 | 11.4 | 0.45 |
| rear edge of same | 13.5 | 0.53 |
| forward edge of insulation crimping tabs 136/134 | 14.0 | 0.55 |
| bell 113 diameter | 2.54 | 0.100 |
| constriction 112 inside diameter | 0.89 | 0.035 |
| body 111/121 outside diameter | 2.54 | 0.100 |
| elevation of conductor-crimping section 128 floor above body 111/121 (and insulation-crimping section 136 floor 133) | 1.14 | 0.045 |
| height of conductor crimping-tab tips 131 above section 128 floor (outside) | 2.03 | 0.080 |
| height of insulator crimping-tab tips 134 above section 136 floor 133 (outside) | 3.3 | 0.13 |
| width of flat at coined tips of tabs 131 and 134 | 0.10 | 0.004 |
| angle of bevel at coined tips to tab axis | 30 degrees | |
| overall width, across tang tips 118 | 3.81 | 0.150 |
| height of tang 117 cross-section, midway from root to tip | 0.76 | 0.030 |
| radius of tang inside surface 126 | 1.27 | 0.050 |

It will be understood that the foregoing disclosure is intended to be merely exemplary, and not to limit the scope of the invention—which is to be determined by reference to the appended claims.

We claim:

1. In combination, a ballast and connecting apparatus for use in a fluorescent-lamp fixture comprising:

at least one electrical winding;

plural electrical leads operatively connected to the winding, for carrying electrical power to and from the winding;

generally enclosing the winding and leads, a housing having two generally upstanding side walls; the housing having two ends;

an electrical half connector disposed at at least one end of the housing;

defined at each side of the half connector, respectively, an ear that extends laterally into association with one said side wall, respectively;

defined in each side wall, immediately adjacent to said one end of the housing, a cutout notch for receiving the connector ear that is associated with that side wall, to retain the connector in place longitudinally at the end of the housing; and plural individual electrical contacts formed from or operatively connected to ends of the electrical leads respectively, and fixed within the half connectors for making electrical connections outside the housing.

2. The combination of claim 1, wherein:

each side wall has a top edge, respectively; and each notch is defined in an upper corner of the housing, at the top edge of the corresponding side wall.

3. The combination of claim 2, wherein:

each ear extends upward to substantially the level of the top edge of the corresponding side wall.

4. The combination of claim 1, wherein:

the winding, leads, and internal portions of the half connector are potted within the housing by pouring of liquid potting material that solidifies around them; and the notches cooperate with the ears to locate the connector firmly against the end of the housing and deter the potting material, while that material is liquid, from leaking out of the housing.

5. The combination of claim 4:

wherein the side walls are resilient and biased outward; and further comprising means for securing the side walls inward, against their resilient bias.

6. The combination of claim 4, wherein:

the housing also has at least one end wall, at the same end of the housing as the half connector;

an orifice is defined in the end wall of the housing; and the connector is disposed at least partly within the housing at the orifice, and firmly against the end wall to deter the potting material from leaking through the orifice.

7. The combination of claim 6, wherein:

the electrical connector protrudes through the orifice to further retain the half connector in place and deter the connector from floating, in the liquid potting material, out of position.

8. The combination of claim 1, wherein:

the housing also has at least one end wall, at the same end of the housing as the half connector;

an orifice is defined in the end wall of the housing; and the connector is disposed at least partly within the housing at the orifice and against the end wall.

9. The combination of claim 8:

wherein the side walls and end walls are resilient and biased outward; and further comprising means for securing the side walls and end walls inward, against their resilient bias, so that at least the end wall firmly engages the half connector.

10. The combination of claim 1, wherein:

each contact is a female element for receiving directly a bared metal end of an electrical wire, respectively.

11. The fixture of claim 10, wherein:

each contact is of resilient conductive material formed generally into a socket that receives and makes a good wiping contact with a respective individual one of the plural electrical wires.

12. The combination of claim 1, further comprising:

a plurality of electrical wires, extending through the fixture but substantially all outside the housing, and each having a respective bared metal end; and wherein:

each contact is a female element that receives directly a bared metal end of one of said outside electrical wires, respectively.

13. The fixture of claim 12, wherein:

each contact is of resilient conductive material formed generally into a socket that receives and makes a good wiping contact with a respective individual one of the plural electrical wires.

14. The combination of claim 12, further comprising:

a second electrical half connector holding all of said outside electrical wires with said bared metal ends in relative positions to directly engage corresponding contacts in the first half connector, respectively.

15. The combination of claim 1, further comprising:

plural electrical wires extending through the fixture but substantially all outside the housing, and having operative electrical interconnection with said leads respectively, for carrying electrical power to and from the housing.

16. The combination of claim 15, further comprising:

a second electrical half connector, holding the plural outside electrical wires near their ends, for mating with the first half connector to effect said operative electrical interconnections between the leads and the wires, respectively.

17. The combination of claim 1, further comprising:

plural electrical wires extending through the fixture but substantially all outside the housing, for carrying electrical power to and from the housing;

a second electrical half connector, holding the plural outside electrical wires near their ends, for mating with the first half connector to effect said operative electrical interconnections between the leads and the wires, respectively.

18. The combination of claim 17, wherein:

each wire is formed as, or has secured to it, an electrical contact for making said operative interconnection with a corresponding lead that is in the housing; and material of the second half connector is displaced by fracture, substantially without flow, into or around each of the wires or contacts, to hold the wires or contacts within the half connector;

whereby strain relief is provided for each wire or contact without using any additional component.

19. The combination of claim 17, wherein:

each wire is formed as, or has secured to it, an electrical contact for making said operative interconnection with a corresponding lead that is in the housing; and material of the second half connector is displaced by fracture, substantially without heating, into or around each of the wires or contacts, to hold the wires or contacts within the half connector;

whereby strain relief is provided for each wire or contact without using any additional component.

20. The combination of claim 1, further comprising:

plural electrical wires extending through the fixture but substantially all outside the housing, for carrying electrical power to and from the housing; each lead being formed as, or having secured to it, an electrical contact for making said operative interconnection with a corresponding lead that is in the housing; and a second electrical half connector for mating with the first half connector to effect said operative electrical interconnections between the leads and the wires, respectively; said second half connector defining a plurality of passageways for receiving the plural outside electrical wires, respectively, near their ends; each passageway having a respective interior wall;

wherein material of the second half connector is displaced to form plural pieces of said material that are wedged between the wires or contacts and the corresponding passageway walls, respectively, to hold the wires or contacts within the second half connector;

whereby strain relief is provided for each wire or contact in the second half connector without using any additional component.

21. The combination of claim 1, wherein:

the housing has two end walls; and one said orifice, one pair of said notches and one said half connector with a corresponding pair of said ears, are at each of said end walls, respectively.

22. The combination of claim 1, further comprising:

lamp sockets operatively interconnected with all of the outside wires, except for certain of the outside wires reserved for supply of electrical power to the ballast.

23. The combination of claim 1, wherein:

the housing is unitary and elongated.

24. The combination of claim 1, further comprising:

a cover secured over the housing, and cooperating with the housing to substantially enclose the coil, core and leads; and wherein:

the housing further comprises a bottom wall; and the side walls are upstanding from the bottom wall.

25. A procedure for fabricating a fluorescent-lamp ballast, said procedure comprising the steps of:

preparing at least one electrical winding, with plural electrical leads operatively connected to carry electrical power to and from the winding;

preparing a housing, for generally enclosing the winding and leads, that includes two generally upstanding side walls; the housing having two ends; wherein the housing-preparing step includes the substep of defining a cutout notch in each side wall, immediately adjacent to an end of the housing;

forming from or operatively connecting to ends of the electrical leads, respectively, a plurality of individual electrical contacts;

preparing an electrical half connector that defines, at each side of the half connector respectively, an ear for extending laterally into association with one side wall, respectively; wherein the connector-preparing step includes fixing the contacts within the half connector for use in making electrical connections outside the housing; and then positioning the winding and leads within the housing and positioning the electrical half connector at one end of the housing, with the ears inserted into the cutout notches, respectively.

26. The procedure of claim 25, wherein:

the housing-preparing step comprises biasing the side walls outward; and further comprising the additional step of:

after the positioning step, moving the side walls inward, against the outward bias.

27. The procedure of claim 26, wherein:

the side-wall-moving step comprises placing the housing, with the winding, leads and connector, in a fixture that holds the side walls inward.

28. The procedure of claim 26, further comprising the subsequent step of:

permanently securing the side walls moved inward.

29. The procedure of claim 28, wherein:

the permanently-securing step comprises affixing a cover that engages the side walls and holds them inward against the outward bias.

30. The procedure of claim 26, further comprising the subsequent steps of:

while the side walls remain inward, pouring liquid potting material into the housing around the winding, leads, and internal portions of the half connector; and then permanently securing the side walls moved inward.

31. The procedure of claim 30, wherein:

the permanently-securing step comprises affixing a cover that engages the side walls and holds them inward against the outward bias.

32. The procedure of claim 30, wherein:

during said pouring step, and thereafter while the potting material remains liquid, the notches cooperate with the ears to retain the half connector in position at the end of the housing and deter the potting material from leaking out of the housing.

33. The procedure of claim 30, wherein:

the housing-preparing step comprises forming the housing with at least one end wall, at the same end of the housing as the half connector, and defining an orifice in the end wall of the housing; and the positioning step comprises disposing the half connector at least partly within the housing at the orifice, and firmly against the end wall to deter the potting material from leaking through the orifice.

34. The procedure of claim 33, wherein:

the connector-disposing step further comprises inserting the electrical connector to protrude through the orifice, to further retain the half connector in place and deter the half connector from floating, in the liquid potting material, out of position.

35. The procedure of claim 33, wherein:

the housing-preparing step comprises forming the end wall with a pair of tabs, one at each side near a top edge of the end wall, and bending the tabs to extend adjacent to the notches in the side wall;

said tabs being disposed to form lateral stops for the ears of the connector.

36. The procedure of claim 35, wherein:

the housing-preparing step further comprises deforming the tabs to extend inboard to engage the ears.

37. The procedure of claim 33, wherein:

the housing-preparing step comprises biasing the side and end walls outward; and further comprising the additional step of:

after the positioning step but before the pouring step, moving the end wall inward, against the outward bias, to longitudinally engage the connector and to closely capture the ears in the notches; and moving the side walls inward, against the outward bias, to closely approach edges of the end wall;

whereby leakage of the potting material through the orifice, or through the notches, or between the end wall and the side walls, is deterred.

38. The procedure of claim 37, wherein:

the wall-moving step comprises placing the housing, with the winding, leads and connector, in a fixture that holds the side and end walls inward.

39. The procedure of claim 37, further comprising the subsequent step of:

permanently securing the walls moved inward.

40. The procedure of claim 39, wherein:

the permanently-securing step comprises affixing a cover that engages the walls and holds them inward against the outward bias.

41. The procedure of claim 40, wherein:

before said pouring step, the end walls resiliently engage the connector longitudinally, to facilitate assembly by retaining the half connector in place.

42. The procedure of claim 32, wherein:

the notch-defining substep comprises defining said notch in an upper corner of the housing, at a top edge of the corresponding side wall.

43. The procedure of claim 42, wherein:

the half-connector-preparing step comprises forming each ear so that in the positioning step the ears will extend upward to substantially the level of the top edge of the corresponding side wall.

44. The procedure of claim 25, wherein:

the housing-preparing step comprises forming the housing with at least one end wall, at the same end of the housing as the half connector, and defining an orifice in the end wall of the housing; and the positioning step comprises disposing the half connector at least partly within the housing at the orifice, and generally against the end wall.

45. The procedure of claim 44, wherein:

the connector-disposing step further comprises inserting the electrical connector to protrude through the orifice, to further retain the half connector in place.

46. The procedure of claim 45, wherein:

the housing-preparing step comprises biasing the side and end walls outward; and further comprising the additional step of:

after the positioning step, moving the end wall inward, against the outward bias, to longitudinally engage the connector and closely capture the ears; and moving the side walls inward, against the outward bias, to closely approach the end wall.

47. The procedure of claim 46, wherein:

the wall-moving step comprises placing the housing, with the winding, leads and connector, in a fixture that holds the side and end walls inward.

48. The procedure of claim 47, further comprising the subsequent step of:

permanently securing the walls moved inward.

49. The procedure of claim 48, wherein:

the permanently-securing step comprises affixing a cover that engages the walls and holds them inward against the outward bias.

50. The procedure of claim 49, wherein:

before said permanently-securing step, the end walls resiliently engage the connector longitudinally, to facilitate assembly by retaining the half connector in place.

51. The procedure of claim 50, wherein:

the notch-defining substep comprises defining said notch in an upper corner of the housing, at a top edge of the corresponding side wall.

52. The procedure of claim 51, wherein:

the half-connector-preparing step comprises forming each ear so that in the positioning step the ears will extend upward to substantially the level of the top edge of the corresponding side wall.

53. The procedure of claim 25, wherein:

the end wall resiliently engages the connector ears longitudinally, pressing them against edges of the notches to deter the liquid potting material from leaking out of the housing through the notches.

* * * * *